United States Patent [19]

Smith

[11] Patent Number: 4,923,339

[45] Date of Patent: May 8, 1990

[54] FOLDABLE CONCRETE RETAINING WALL STRUCTURE

[75] Inventor: Peter J. Smith, Gansevoort, N.Y.

[73] Assignee: Fomico International, Inc., Fort Edward, N.Y.

[21] Appl. No.: 95,959

[22] Filed: Sep. 14, 1987

[51] Int. Cl.[5] ..... E02D 17/20; E02D 29/02

[52] U.S. Cl. ..... 405/284; 405/286; 405/273; 52/69; 52/561

[58] Field of Search ..... 52/69, 98, 421, 561, 52/566, 589, 631, 593; 405/258, 284–287, 272, 273, 282, 283

[56] References Cited

U.S. PATENT DOCUMENTS

| | | | |
|---|---|---|---|
| 918,366 | 4/1909 | Quereau | 52/98 |
| 1,361,831 | 12/1920 | Crew . | |
| 1,847,852 | 3/1932 | Upson . | |
| 1,847,868 | 3/1932 | Everham . | |
| 2,054,499 | 9/1936 | Florman | 264/242 X |
| 2,149,957 | 3/1939 | Dawson . | |
| 2,384,994 | 9/1945 | Gutman et al. | 52/98 X |
| 2,674,856 | 4/1954 | Louckes . | |
| 2,828,613 | 4/1958 | Wilson . | |
| 2,960,797 | 11/1960 | Frehner | 47/33 |
| 3,269,125 | 8/1966 | Moore . | |
| 3,305,982 | 2/1967 | Steele | 52/593 X |
| 3,343,301 | 9/1967 | Adelman | 47/33 |
| 3,444,694 | 5/1969 | Frehner . | |
| 3,478,999 | 11/1969 | Charman, Jr. et al. . | |
| 3,494,092 | 2/1970 | Johnson et al. | 52/69 |
| 3,925,994 | 12/1975 | Broms et al. | 405/258 |
| 4,407,611 | 10/1983 | Murray et al. | 405/284 |
| 4,440,527 | 4/1984 | Vidal | 405/284 |
| 4,684,294 | 8/1987 | O'Neill | 405/286 |
| 4,704,837 | 11/1987 | Menchetti et al. | 52/631 |

FOREIGN PATENT DOCUMENTS

| | | | |
|---|---|---|---|
| 2496141 | 6/1982 | France | 405/284 |

*Primary Examiner*—Dennis L. Taylor
*Assistant Examiner*—John A. Ricci
*Attorney, Agent, or Firm*—Kenyon & Kenyon

[57] ABSTRACT

Individual precast concrete wall units for erecting a retaining wall structure each include a face member, a support member, and an anchor member. The support member has a front end portion, that is connected by a hinge to one end of the face member, and a rear end portion, that is connected to one end of the anchor member, either by a tongue-and-slot arrangement or by another hinge. The wall units can be cast straight, thus simplifying the design and reducing the space occupied by the mold. The wall units can also be transported and stored in the straight condition to save space. At the job site, the units are quickly and easily folded into an open bin-like form for placement side-by-side to construct a retaining wall.

20 Claims, 14 Drawing Sheets

FOLDABLE CONCRETE RETAINING WALL STRUCTURE

BACKGROUND OF THE INVENTION

1. Technical Field

The present invention relates to retaining walls and particularly to stackable precast concrete bin-type structures for creating retaining walls.

2. Background Information

A gravity retaining wall is the simplest and probably the oldest known kind of retaining wall. This type of wall relies on the mass of the wall material and a configuration that normally decreases in thickness from base to top to resist the overturning force exerted by the pressure of earth behind it. Gravity retaining walls are usually made of stone, concrete block, or monolithic concrete poured at the site.

Another type of retaining wall is a cribbing wall constructed from interlocking timbers or precast concrete elements. Examples of concrete cribbing arrangements are disclosed in U.S. Pat. Nos. 2,149,957 of Dawson and 2,828,613 of Wilson. The Dawson cribbing wall is assembled from three different rigid precast concrete elements: stretchers, headers, and anchors. The stretchers and headers are elongated straight elements having interengaging socket-and-lug ends that can be locked together by impaling rods. The stretchers form the face of the wall, and the headers extend perpendicularly to the face into the bank behind the wall. The anchors are U-shaped elements that interengage with the inner ends of the headers to create a hollow box-like structure, or crib. Each rigid element is cast separately, and the cribbing is assembled piece-by-piece at the site. The Wilson cribbing assembly is made up of identical precast concrete blocks. The blocks are notched so that they can be assembled like a log cabin to provide a zig-zag, a triangular, or a square configuration.

A special type of retaining wall structure has been developed for sloping banks. Examples of this type are terraced retaining wall assemblies shown in U.S. Pat. Nos. 3,343,301 of Adelman, 2,960,797 and 3,444,694 of Frehner, and 3,269,125 of Moore. Adelman provides individual rectangular blocks that are small enough and light enough to be carried by one person. Each block has a semicylindrical shoulder at each end, the shoulder having a pivot hole, so that the blocks can be hinged together on upright pins in a zig-zag arrangement. Successive courses of the blocks are arranged in stepwise setback fashion to create a terraced retaining wall. The sole anchoring of the wall is provided by the hinge pins; the blocks form only the face of the wall. The Frehner and Moore structures use rigid two-sided angled blocks of an open V or U shape to create a terraced wall similar in appearance to the Adelman wall.

Still another type of retaining structure that is suitable for horizontal or slightly sloped surfaces is a flexible revetment mat, as disclosed by U.S. Pat. Nos. 2,674,856 of Louckes, 1,847,852 of Upson, and 1,847,868 of Everham. In the Louckes structure, which is a typical example, a number of slightly spaced concrete blocks are cast in a rectangular array and are reinforced and bound together by a continuous structure of wire fabric. The resulting mat has the necessary flexibility to adjust itself to irregularities of a river bank or bed. This type of mat is not usable as retaining wall on a steep slope, however, because it relies only on the force of gravity to hold it against the earth surface.

More recently, precast rigid so-called bin-type elements have been developed that can be stacked to make a vertical retaining wall. In most systems, individual units interlock with other units to form an integral structure of open bins which are subsequently backfilled with gravel to add the necessary mass to the wall structure. These elements are of various shapes, but they typically have a flat face panel, an anchor member, and at least one web or spacer extending between the rear of the face panel and the anchor. These elements are normally designed to be stacked only in a straight line. In addition, they require relatively large, complex, and expensive molds, and because of their rigid, three-dimensional shape, they take up a large amount of space for storage and shipping relative to the wall area provided by the face panel.

SUMMARY OF THE INVENTION

It is a principal object of the present invention to provide a retaining wall of precast concrete bin-type units which may be arranged in either a straight or curved configuration; both of which configurations may be constructed using the same adjustable, variable or "foldable" standard units.

Another object of the invention is to provide precast concrete bin-type retaining wall units that can be cast in straight molds and can be transported flat, yet require minimum assembly at the job site.

Another object of the invention is to provide precast concrete bin-type retaining wall units having a high strength-to-weight ratio.

Yet another object of the invention is to provide concrete retaining wall units that are light in weight relative to the maximum safe height of wall that can be assembled with the units.

Still another object of the invention is to provide concrete retaining wall units that are light enough to be lifted by one person yet large enough to provide earth retaining capability to a height of at least ten feet.

Another object of the invention is to provide concrete retaining wall units that create an interlocked vertical retaining wall when stacked in staggered rows without the need for additional fastening means.

A further object of the invention is to provide concrete bin-type units for a retaining wall that can be cast in low-cost, straight, non-labor intensive molds and subsequently folded to create an angular bin element.

Another object of the invention is to use a straight mold which requires a minimum of labor to use.

The above and other objects are achieved by a precast concrete retaining wall unit for use in constructing a bin-type retaining wall composed of superposed rows of such units, the unit comprising:

a face member having a front surface, a rear surface, an upper edge, a lower edge, and first and second side edges;

a support member having a front end portion adjacent to the second side edge of the face member, a rear end portion spaced from the front end portion, and an intermediate portion connecting the front and rear end portions;

means for connecting the front end portion of the support member to the face member adjacent to the second side edge of the face member to permit the support member to extend transversely to the rear surface of the face member;

first and second interengaging means located in the vicinity of the respective first and second side edges of the face member, said first interengaging means of said unit being adapted to engage the second interengaging means of a like unit, when the second side edge of the face member of the like unit abuts the first side edge of the face member of said unit, to restrain the face member of said unit from forward movement with respect to the face member of the like unit; and third and fourth interengaging means located in the vicinity of the upper and lower edges of the face member, respectively, said third interengaging means of said unit being adapted to engage the fourth interengaging means of another like unit, when the lower edge of the face member of the other like unit abuts the upper edge of the face member of said unit with the other like unit being shifted laterally by a predetermined amount with respect to said unit, to restrain the face member of said other like unit from movement in at least one direction laterally and one direction transversely with respect to the face member of said unit.

Preferably, the connecting means of the precast wall unit comprises means for connecting the front end portion of the support member to the second side edge of the face member to permit pivoting the support member with respect to the second side edge of the face member through at least 120 degrees between a position in which the support member is substantially coplanar with the face member to a position in which the support member is substantially perpendicular to the face member.

In particular, the means for hingedly connecting the front end portion of the support member to the face member comprises a flexible tensile reinforcing web or hinge disposed in a first intermediate plane of the face member and in a second intermediate plane of the support member; said web may provide tensile reinforcement for the face member and the support member in addition to providing a hinge connection between the front end portion of the support member and the face member. The flexible tensile reinforcing web may be an open-mesh metal web, an open-mesh web of high strength polymeric material such as high density polyethylene, or a metal-reinforced plastic mesh. Other hinge devices may be specifically formed or molded from high density polyethylene or may be fabricated from galvanized, plain, or epoxy-coated steel.

In its simplest form, the hinged retaining wall unit includes only a face member and a support member, but the support member may incorporate means in the rear end portion for connecting to a first end of an anchor member. The connecting means may be a slot in the rear end portion of the support member that accepts a tongue extending from the first end of the anchor member. Another tongue extending from the second end of the anchor member is similarly connectable with a slot in the rear end portion of a support member of the next unit in a row. The face and support member of the first unit, the anchor member, and the support member of the next unit thereby interconnect to form a four-sided bin that can be backfilled with gravel or other mass-creating material.

Alternatively, the hinged retaining wall unit can include an anchor member hingedly connected to the rear end portion of the support member, preferably by a same tensile reinforcing web or hinge that provides a hinge connection between the front end portion of the support member and the face member. Such a construction permits the three members (face, support and anchor) to be cast simultaneously end-to-end in an inexpensive, easily operated flat mold.

BRIEF DESCRIPTION OF THE DRAWINGS

Additional features and advantages of the invention will be discussed in the following detailed description of specific preferred embodiments shown by the drawings, in which.

DETAILED DESCRIPTION OF THE PREFERRED EMBODIMENTS

Figure 2:
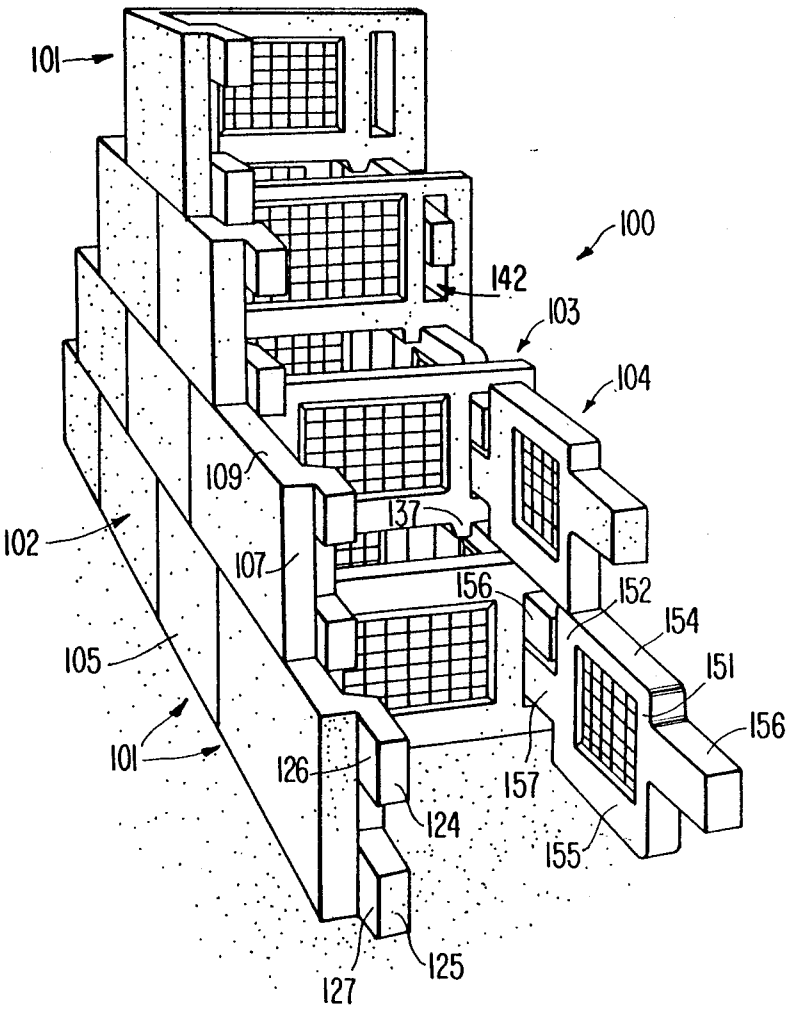
FIG. 2 is a perspective view of several vertically stacked rows of precast concrete units as shown in FIG. 1 in an intermediate stage of assembly to form a retaining wall structure.

In the following description, the same or like elements in different figures will be identified by the same reference numerals. Dashed lines, for showing hidden structure, are used only to the extent believed to be useful for showing the structure of the members without unnecessary clutter in the figures.

Figure 1:
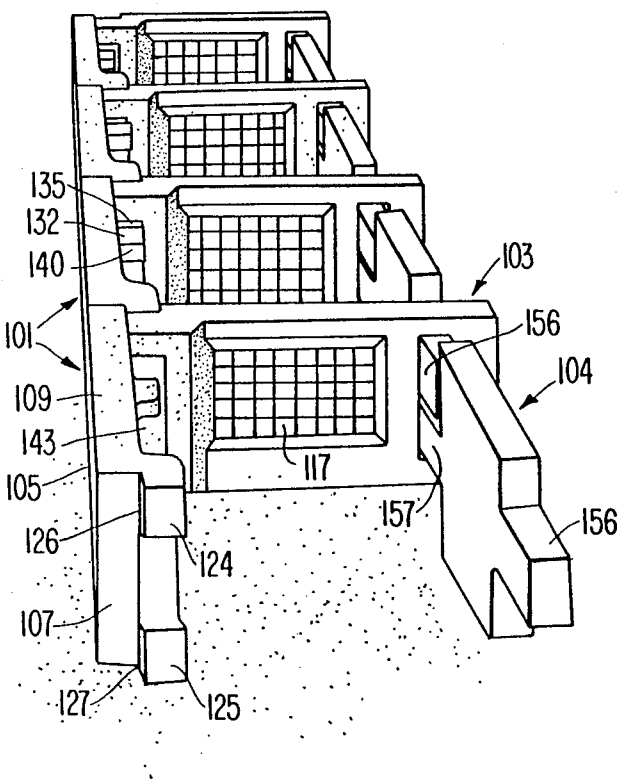
FIG. 1 is a perspective view of an assembled row of precast concrete retaining wall units according to a first embodiment of the invention.

To introduce the general field of the invention and the intended use of the invention, FIGS. 1 and 2 illustrate two stages in the assembly of a retaining wall 100 composed of stacked rows of interlocking individual wall units 101 according to a first embodiment of the invention. The units are first stacked in a single row conforming to the desired line of the wall, as shown in FIG. 1. The line of the wall shown in FIGS. 1 and 2 is straight, but as will be explained below, one of the main advantages of the wall units of the present invention is that standard units provide flexibility for creating a retaining wall of substantial curvature, either concave or convex.

Additional units are stacked in further rows on the units in the first row, as shown in FIG. 2. The units in each succeeding row are shifted to straddle two units in the row on which they rest, and each unit includes means for interengaging contiguous units above, below, and to each side to create a self-locking wall structure. Although not shown in FIG. 2, to avoid obscuring details, each row or course of units is usually backfilled and tamped before proceeding to lay the next course.

FIGS. 3–7 show the construction and features of an individual wall unit embodiment 101 in enlarged detail. Each wall unit 101 includes a face member 102, a support member 103, and preferably an anchor member 104.

The face member 102 preferably is formed as a rectangular panel having a front surface 105, a rear surface 106, first and second side edges 107, 108, an upper edge 109, and a lower edge 110. The face member has relatively thick edge portions that form a rectangular frame, but a central part 111 of the rear surface is relieved to reduce weight without sacrificing strength.

The support member 103 has a front end portion 112, a rear end portion 113, and an intermediate portion 114 that connects the rear end portion to the front end portion. In this embodiment, the intermediate portion is formed as an upper bar 115 and a lower bar 116 which, together with the front and rear end portions 112, 113 create a generally rectangular open frame shape for the support member. This open frame shape provides strength and rigidity with minimum weight, and the open center facilitates the distribution of backfill material between adjacent wall units.

Figure 5:
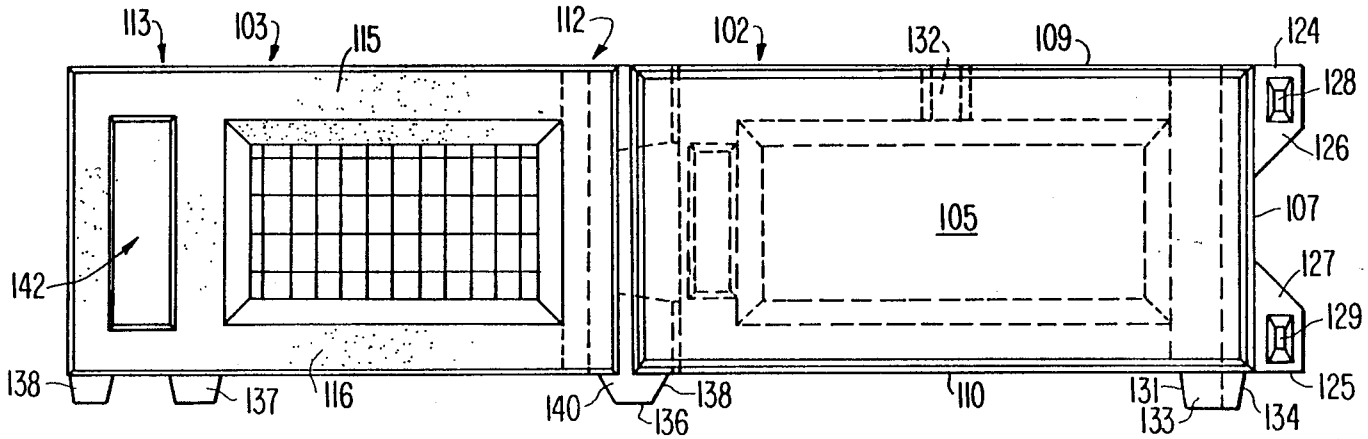
FIG. 5 is a front elevation view of the face member and support member of FIG. 3.
Figure 6:
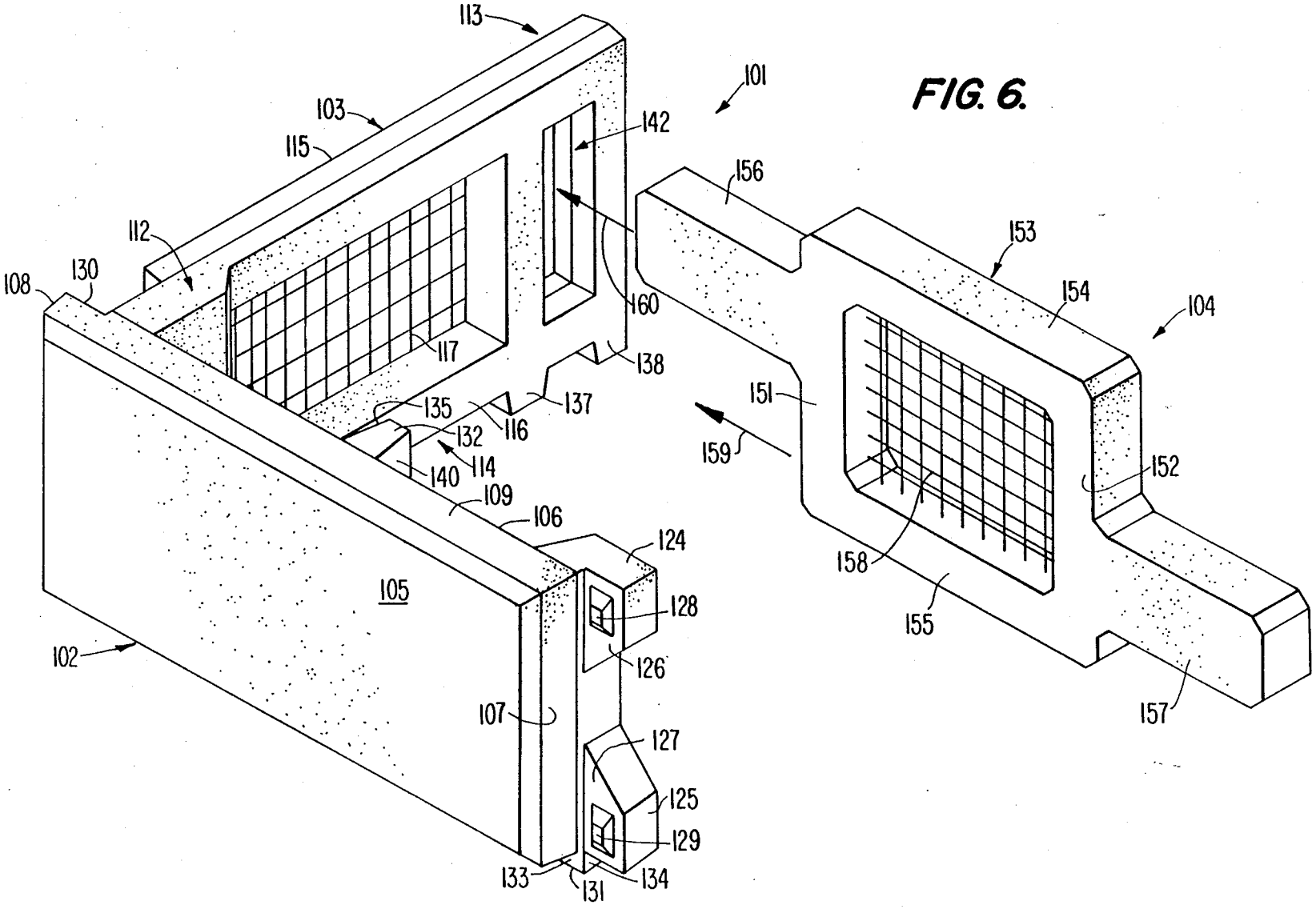
FIG. 6 is a perspective view of the hingedly connected face member and support member embodiment of FIGS. 3–5, in folded condition, showing the manner of connecting a first end of an anchor member to a rear end portion of a support member.
Figure 7:
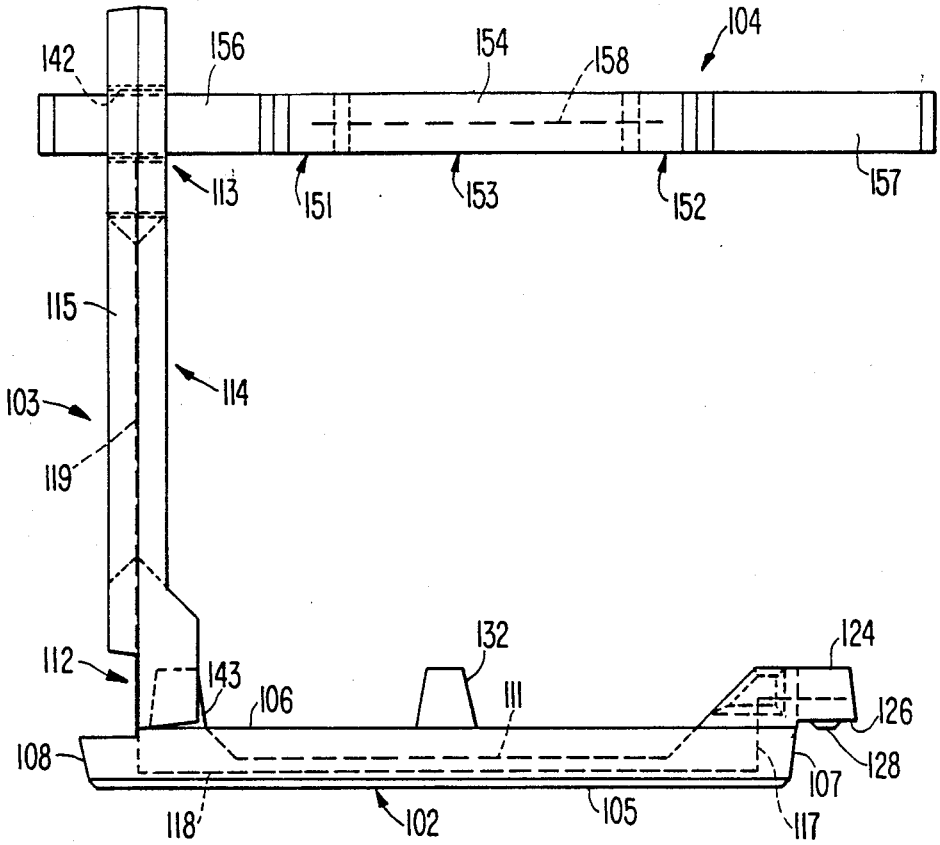
FIG. 7 is a top plan view of the assembled wall unit of FIG. 6.

The front end portion of the support member 103 is connected to the rear surface of the face member 102 near the second side edge 108 so that the support member can extend transversely to the face member, as shown in FIGS. 6 and 7. The connecting means preferably are in the form of a hinge means, as described in more detail below, to permit the support member to pivot relative to the face between a position in which the two members are substantially coplanar (FIGS. 3–5) and a position in which the support member is substantially perpendicular to the face member (FIGS. 6 and 7). This hinged connection feature allows the two members to be cast in a single flat mold and to be shipped as a single flat unit, thereby taking up minimum space. At the job site, the two members can be folded to approximately a right angle so that the support member will maintain the face member in an upright position and will serve as one side of a bin structure.

Figure 3:
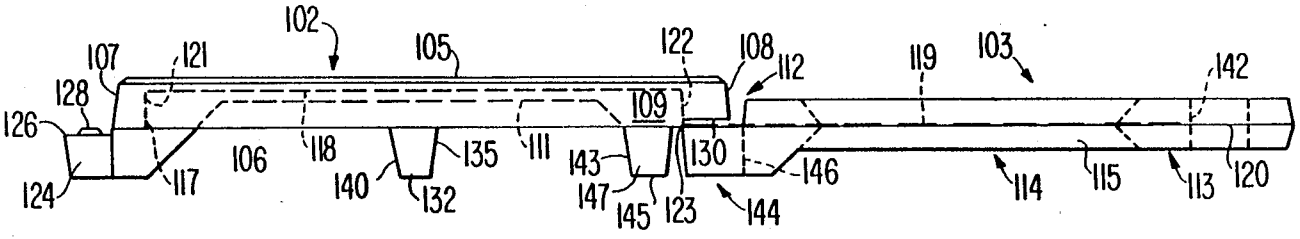
FIG. 3 is a top plan view of a face member and support member of one of the wall units of FIGS. 1 and 2, that are hingedly connected by a flexible tensile reinforcement web, in unfolded condition.
Figure 4:
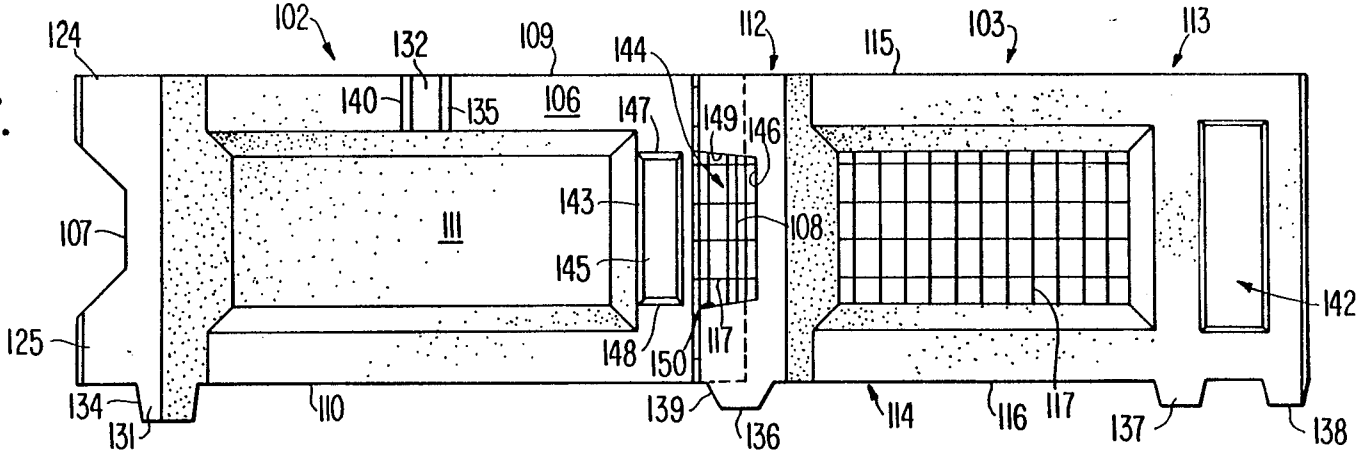
FIG. 4 is a rear elevation view of the face member and support member of FIG. 3.

As shown best in FIGS. 3–5, the hinge means may consist of a tensile reinforcing web in the form of an open mesh or screen 117 that extends in a first plane 118 in the face member and a second plane 119 in the support member. This reinforcing web can be made of metal wires, preferably protected from corrosion by an appropriate metal or plastic coating, or it can be made from a high strength plastics material, either plain or reinforced with steel wires or cable.

The two hingedly connected members 102 and 103 are molded, as indicated above, in a single straight form (not shown) having facing halves that meet at a central plane 120 (FIG. 3) and that conform to the surfaces of the face member and support member when these members are in the relative positions shown in FIGS. 3–5.

A reinforcing web 117, cut to size and formed with bends 121, 122, and 123 (FIG. 3) is first placed in the form, which is then filled with an appropriate concrete mix. The web can be positioned accurately in the form or mold with the aid of plastic clips commercially available for this purpose. The clips also maintain the web in position during the mold-filling operation.

The preferred concrete mix includes a conventional light weight aggregate to minimize weight without reducing strength. Commercially available agents for temporarily increasing the fluidity or flowability of the mix also can be used. in a manner well known in the art.

As is clearly apparent from FIGS. 3–5, all surfaces of the face member and the support member that extend transversely to the central plane 120 are bevelled to provide draft for ease in stripping the form from the members after the concrete has cured. In some instances, these bevelled surfaces also facilitate interengaging or interlocking the members of one unit with members of an adjacent unit in an assembled wall structure. In this connection, the previously mentioned various interengaging means are clearly shown in the views of FIGS. 3-5.

These interengaging means include a first tab 124 and a second tab 125 extending longitudinally beyond the first side edge 107 in line with the upper and lower edges 109 and 110, respectively, of the face member. Tabs 124, 125 have respective front faces 126, 127 that are provided with integral locating bumps or pads 128, 129 that lie roughly in the plane of rear surface 106 of the face member. The locating bumps 128, 129 are intended to contact a rear surface 130 (FIG. 3) adjacent to the second side edge 108 of a face member of another wall unit placed adjacent to the first side edge of a given wall unit. The purpose of the locating bumps is to align the front surfaces of the adjacent face members and to provide a clearance between the tab front faces 126, 127 of one face member and the corresponding rear surface 130 of an adjacent face member to accommodate setting the face members at slight angles to create convex or concave retaining wall structures, as explained in more detail below in connection with FIGS. 20 and 21.

The face member 102 also has a third tab 131 that extends downwardly beyond the lower edge 110 and a fourth tab 132 that extends rearwardly from the rear surface 106 adjacent to the upper edge 109. Tabs 131 and 132 help to locate a face member of one wall unit in a second row flush with and in staggered relation to a face member of another wall unit in a first row. The flush locating function is accomplished by setting the one wall unit of the second row on top of the first row such that a front surface 133 (FIG. 5) of the third tab 131 of the face member of the one wall unit contacts the rear surface 106 of the face member of the other unit. The staggered locating function is accomplished by simultaneously abutting a side edge 134 of the third tab 131 of the one face member With a side edge 135 of the fourth tab 132 of the other face member.

The support member 103 of each Wall unit 101 also is provided with interengaging means including a front tab 136 and a pair of longitudinally spaced rear tabs 137, 138. A front edge 139 of the front tab abuts the rear surface 106 of a face member of a wall unit in the row beneath, and an outside face 139 (FIG. 5) of the front tab simultaneously contacts a side edge 140 (opposite side edge 135) of a third tab 132 of the underneath face member to provide front-to-rear and side-to-side locating functions for the second side of the face member of an upper wall unit on an underneath wall unit. Thus the front tab 136 of the support member performs locating functions for the second side of each face member comparable to the locating functions performed for the first side of the face member by the first and second tabs 124, 125.

The pair of rear tabs 137, 138 interlock with the anchor member 104 of the wall unit that assembles with a slot 142 in the rear portion of the support member, as will be described in connection with FIGS. 6 and 7.

A final feature of the hinged face member/support member combination is a stop 143 extending from the rear surface 106 of the face member closely adjacent to the location of the bend 123 in the reinforcing web that determined the hinge location. Stop 143 is sized to matingly fit into a recess 144 formed in the front portion 112 of the support member when the two members are folded toward each other. At the same time, upper and lower faces 147 and 148 of stop 143 engage respective upper and lower faces 149 and 150 of recess 144 to interlock the support member and face member against relative vertical displacement.

FIGS. 6 and 7 show the face member 102 and the support member 103 in the folded condition for assembly into a retaining wall structure. With particular reference to FIG. 6, one embodiment of an anchor member 104, which forms the third member of the wall unit, has a first end portion 151, a second end portion 152 spaced from the first end portion, and an intermediate portion 153 connecting the first and second end portions. In this embodiment, the intermediate portion consists of an upper bar 154 and a lower bar 155 which join with the first and second end portions to form a rectangular open frame. As in the support member, this open frame construction provides a high strength-to-weight ratio.

A first tongue 156 extends longitudinally from the upper part of first portion 151 and a second tongue 157 extends longitudinally from the lower part of second end portion 152. As with the face member and support member, the anchor member is provided with a tensile reinforcing web or mesh 158.

The anchor member is assembled with the support member by inserting the first tongue 156 into slot 142 in the rear end portion of the support member in the direction of arrows 159 and 160 in FIG. 6. Alternatively, the second tongue 157 can be inserted into the slot, as illustrated in FIGS. 1 and 2.

In either case, the other tongue inserts into a corresponding slot in an adjacent wall unit. Each tongue is approximately half the height of the slot, and because the two tongues are vertically offset, the first tongue of one anchor member will fit snugly in the slot with a second tongue of an adjacent anchor member. The resulting assembly of an anchor member with a hinged combination of a face member and a support member produces a three-sided wall unit as shown in FIG. 7.

Figure 8:
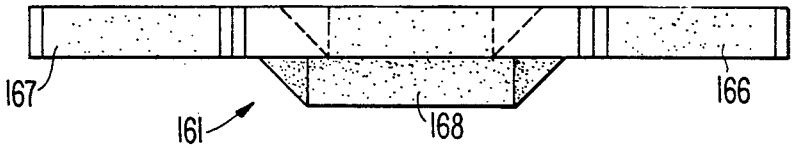
FIG. 8 is a top plan view of an alternative embodiment of an anchor member for a wall unit according to the invention.
Figure 10:
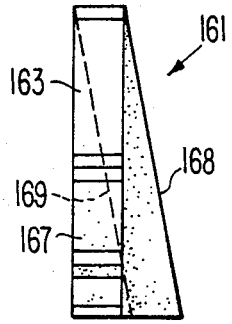
FIG. 10 is an end elevation view of the anchor member of FIG. 8.
Figure 9:
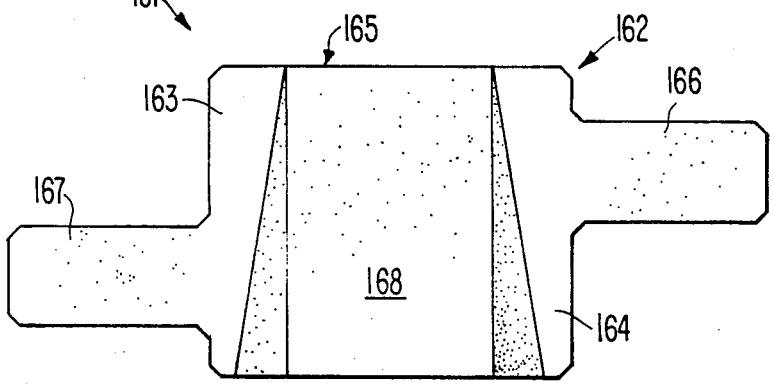
FIG. 9 is a front elevation view of the anchor member of FIG. 8.

FIGS. 8-10 illustrate an alternative embodiment of an anchor member 161 having a solid generally rectangular body 162 with a first end portion 163 and a second end portion 164 joined by an intermediate portion 165. A first tongue 166 extends from the first end portion, and a second tongue 167 extends from the second end portion. The two tongues have the same shape, size, and relative location as the first and second tongues of the anchor member 104 shown in FIGS. 6 and 7. Thus, the anchor member 161 is interchangeable with an anchor member 104.

The intermediate portion of anchor member 161 has a wedge-shaped rear surface 168, as seen most clearly in FIG. 10. A front surface 169 of the intermediate section generally parallels the rear surface, as indicated by the dashed lines in FIGS. 8 and 10, to avoid excessive weight. The wedge shape of the rear surface is intended to provide additional stability to the wall unit.

Figure 11:
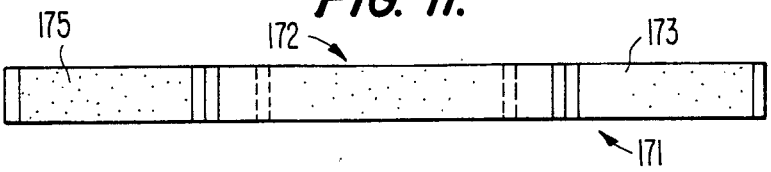
FIG. 11 is a top plan view of a second alternative embodiment of an anchor member according to the invention.
Figure 12:
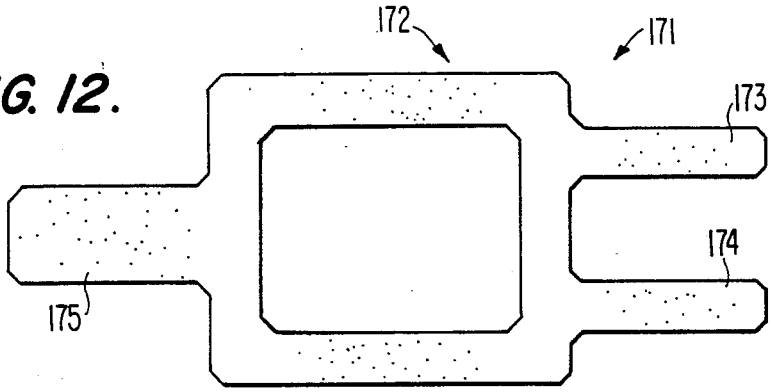
FIG. 12 is an elevation view of the anchor member of FIG. 11.

FIGS. 11 and 12 illustrate another alternative embodiment of an anchor member 171 having an open rectangular frame body 172 identical to that of anchor member 104. This embodiment has two tongues, an upper tongue 173 and a lower tongue 174, extending from one end of the body and one central tongue 175 extending from the other end of the body. The central tongue of one anchor member 171 will interfit between the upper and lower tongues of an adjacent anchor member of the same type.

Figure 13:
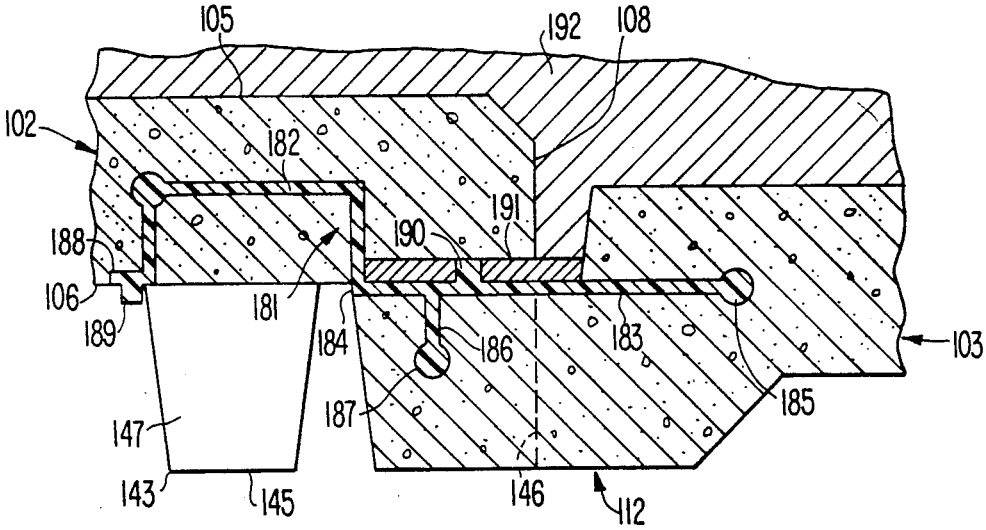
FIG. 13 is an enlarged cross-sectional detail of an alternative hinge arrangement connecting the front end portion of a support member to a face member.
Figure 14:
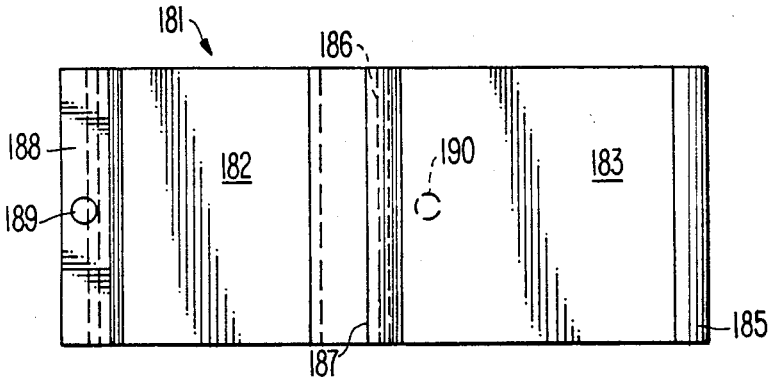
FIG. 14 is a front elevation view of the hinge member shown in the arrangement of FIG. 13.
Figure 15:
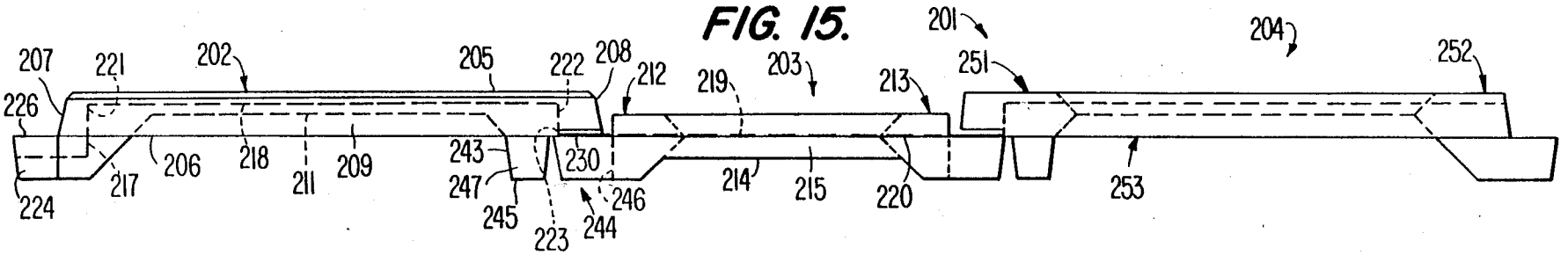
FIG. 15 is a top plan view of an alternative embodiment of a retaining wall unit in unfolded condition.
Figure 16:
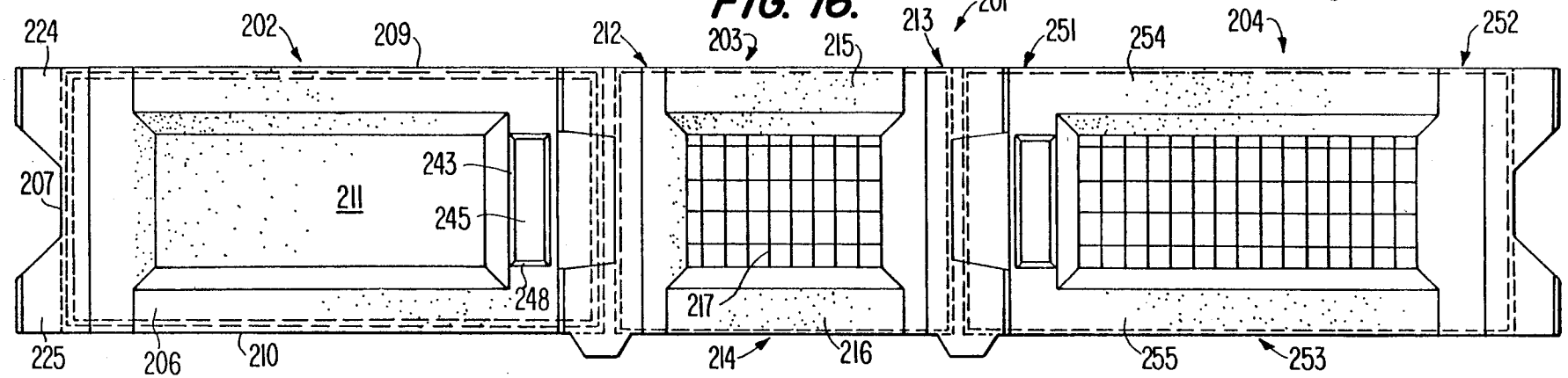
FIG. 16 is a rear elevation view of the retaining wall unit as shown in FIG. 15.
Figure 17:
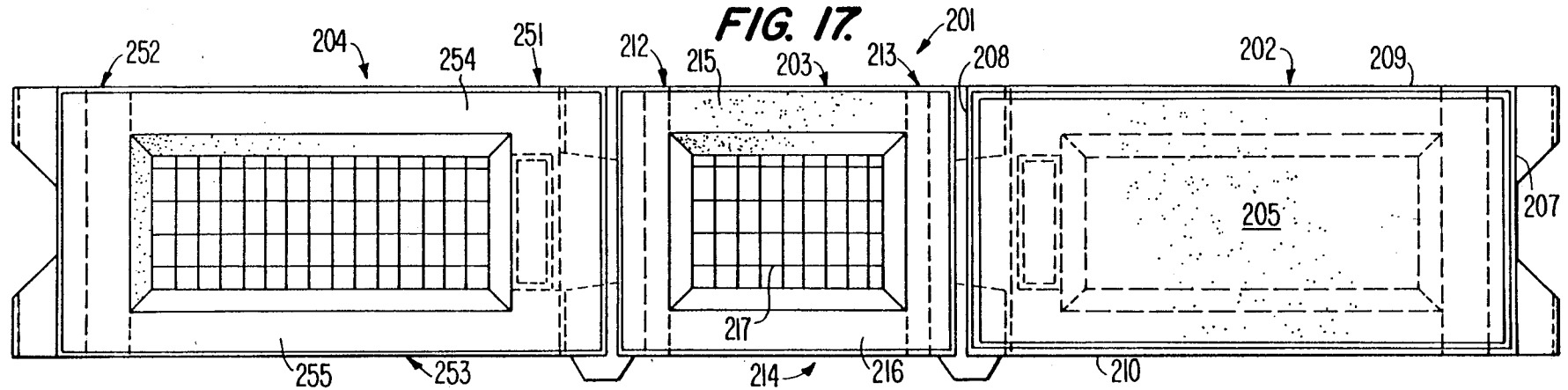
FIG. 17 is a front elevation view of the retaining wall unit as shown in FIG. 15.
Figure 18:
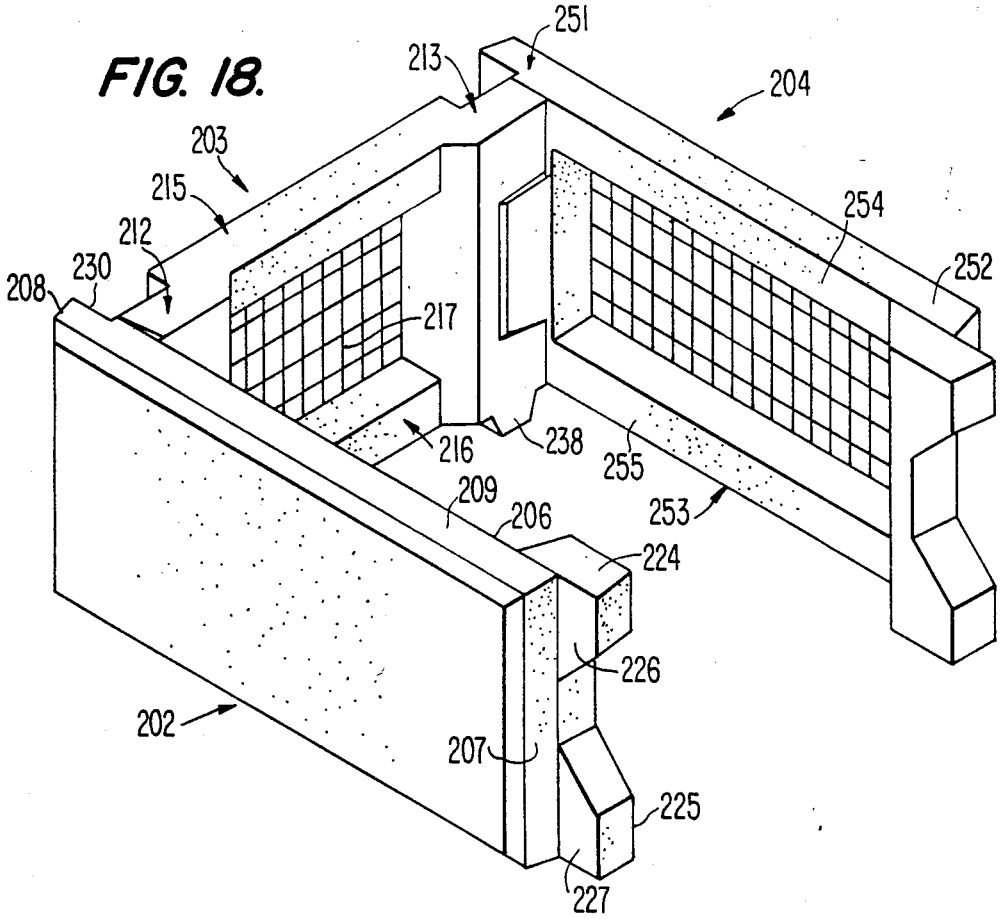
FIG. 18 is a perspective view of the alternative embodiment of a retaining wall unit of FIGS. 15–17 in folded condition according to the invention.
Figure 19:
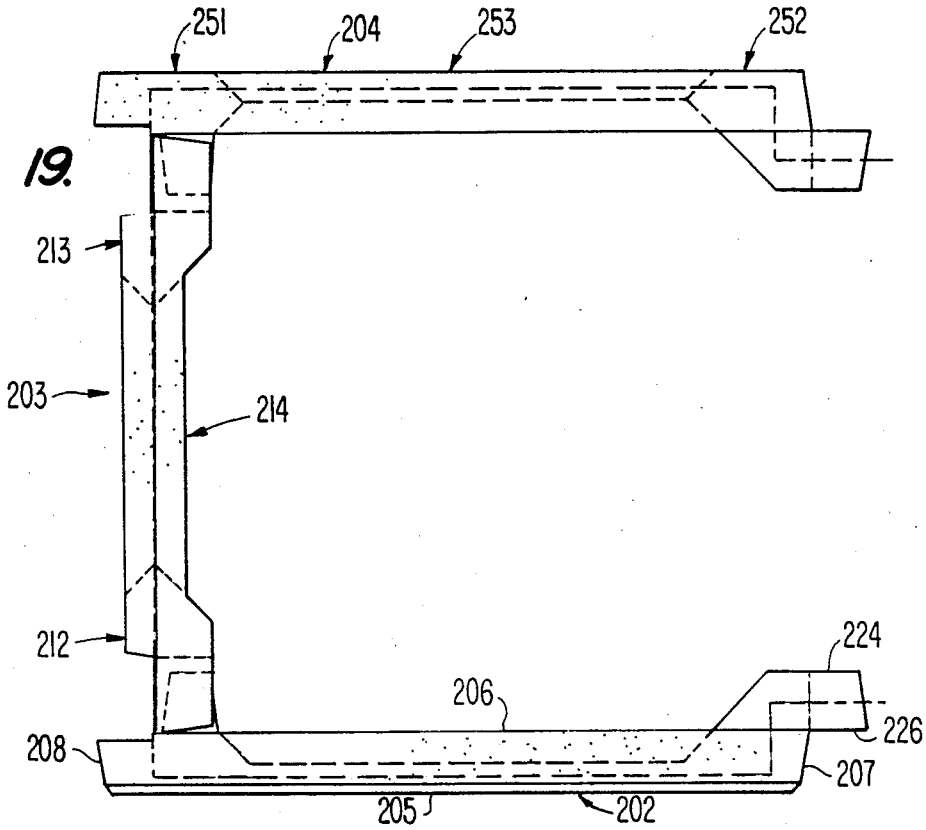
FIG. 19 is a top plan view of the folded retaining wall unit of FIG. 18.

FIGS. 13 and 14 show an alternative hinge embodiment. Instead of using a conventional reinforcing web or mesh to serve also as a hinge, it is possible to substitute two specially molded plastic hinges 181 respectively above and below the recess in the front end portion of the support member. FIG. 13 is a plan view in section of such a hinge in situ, and FIG. 14 is an elevation view of the hinge by itself.

Hinge 181 includes a first channel portion 182 of U-shaped cross section that is adapted to be imbedded in a face member 102, above (and also below) the stop 143 and a second straight portion 183 extending from a junction 184 with the channel portion and adapted to be imbedded in the front end portion 112 of a support member 103 above (and also below) the recess for the stop. The straight portion 183 has an enlarged edge bead 185 and is provided with an integral transverse flap 186 having an enlarged edge bead 187 to anchor the second portion 183 securely to the front end portion of the support member.

On a lip 188 of an edge of the channel portion 182 opposite the junction 184 a locating button 189 is provided for temporarily attaching the hinge to a form half (not shown). Another locating button 190 extends from the straight portion 183 for temporarily attaching the hinge to a filler strip 191 that is placed in the form in abutment with another form half 192 to assure clean separation of the face member from the support member after curing. As will be clear to those of skill in the art, the same type of filler strip should be used when casting the two-member hinged embodiment shown in FIGS. 3–5, as well as a next described three-member hinged embodiment.

With reference next to FIGS. 15–19, an alternative embodiment of a wall unit 201 has all three members—a face member 202, a support member 203, and an anchor member 204—hingedly connected by a single reinforcing web or mesh 217 in a manner identical to that used for the two-member hinged embodiment of FIGS. 3–7. In the embodiment of FIGS. 15–19, many of the elements are similar or identical to elements in the embodiment of FIGS. 3–7 and are identified by 200-series reference numerals that are the same as the 100-series reference numerals used for the embodiment of FIGS. 3–7. These elements have the same functions as the corresponding elements in the first embodiment and will not be further described here, except to note the salient differences in the two embodiments.

The principal differences are that the third and fourth tabs 131, 132 of the face member 102 and the second tab 138 of the support member 103 of wall unit 101 have been eliminated in this alternative embodiment, since these tabs are not considered to be essential to providing a stable wall assembly. Tabs 131 and 132 need not be eliminated and in fact may still be desirable. Tab 138 is eliminated by necessity, because the support member in this embodiment does not extend beyond the rear face of the anchor unit. Also eliminated in this figure are locating bumps 128, 129 on the first and second tabs of the face member 102 of the first embodiment. As explained below, the second wall unit embodiment of FIGS. 15–19 has less inherent angular adaptability between adjacent units than does the first embodiment of FIGS. 1–7, so that the locating bumps are not needed, although they may still be included, if desired. The anchor member 204 is essentially a twin of the face member 202, except that it is formed as an open rectangular frame, instead of having a solid panel, to save weight. Because of the similarity of the face and anchor members, the rear end portion 213 of the support member 203 is a mirror image of the front end portion 212.

The wall unit 201 has advantages over the wall unit 101 in that all three members are formed together in one straight mold and are hingedly joined together to allow transport in the straight condition and quick folding for installation at the job site. Because the anchor member 204 is essentially identical to the face member 202 and since both are permanently hinged to the support member 203, this embodiment provides less flexibility in wall design, however. As is apparent from the folded condition shown in FIG. 19, this embodiment is adapted primarily for making up straight retaining walls composed of rectangular bins.

Wall unit 201 could be used in curbed walls, however, if the length of anchor member 204 were changed to suit the curvature of the wall. Clever mold design could allow for such changes in length with little change in labor or material cost. While this is not likely to be practical in small units (1′×2′), it could possibly be practical in larger (2′×4′) units. By contrast, the design of the separate anchor member 104 of wall unit 101 permits the erection of retaining walls having significant curvature, either convex or concave. In addition, because the anchor member is separate, the weight of each component of the wall unit 101 is significantly less than the weight of a same size three-member unit 201. Thus, the design of wall unit 101 is better adapted to the do-it-yourself market in small sizes (e.g., one foot by two feet face panel). Even in a 1×2 foot size, the weight of the three-member unit 201 is enough to make the use of lifting machinery desirable, and in a typical two feet by four feet size lifting equipment is essential.

Figure 20:
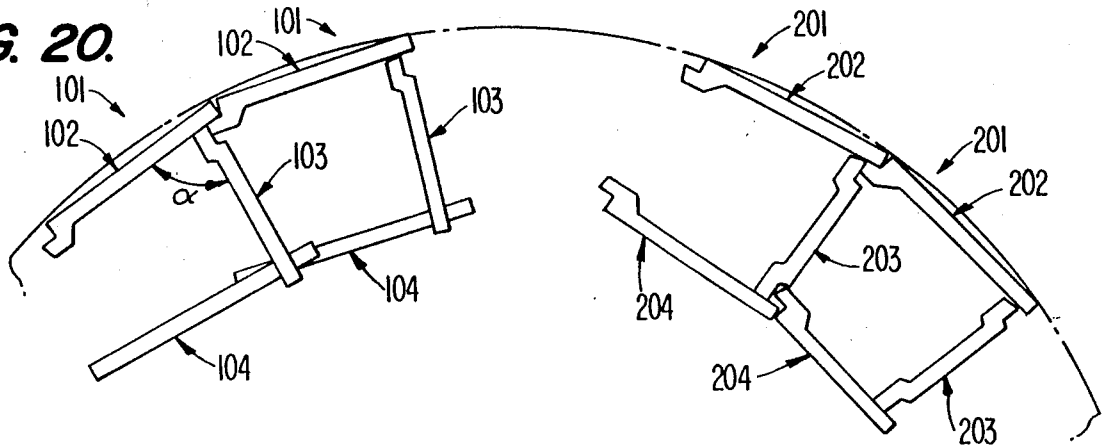
FIG. 20 is a top plan view showing a layout of wall units according to the embodiments of both FIG. 1 and FIG. 18 to create a convex retaining wall.
Figure 21:
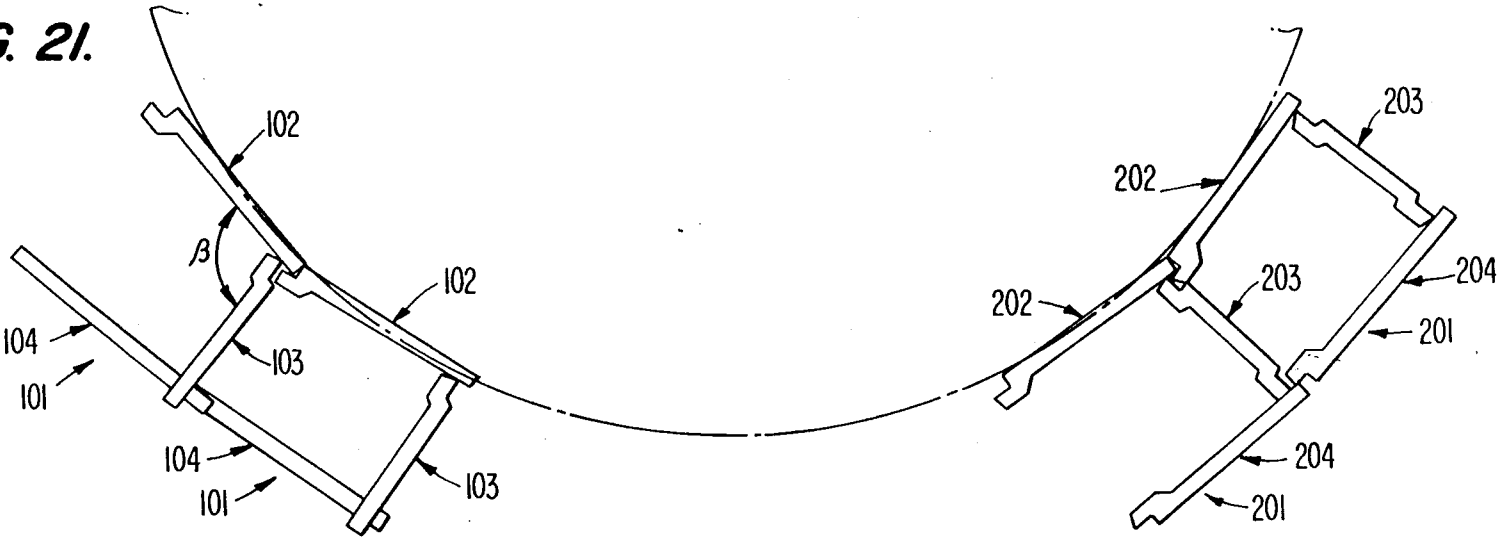
FIG. 21 is a top plan view showing a layout of wall units according to the embodiments of both FIG. 1 and FIG. 18 to create a concave retaining wall.

FIGS. 20 and 21 illustrate in simplified layout form the adaptability of the wall units of the present invention to create walls that range from convex (FIG. 20) to concave (FIG. 21). Layouts of wall units 101 are shown on the left sides of FIGS. 20 and 21; layouts of wall units 201 are shown on the right sides of these figures.

In a wall unit 101, the distance between the outer ends of the tongues 156, 157 of the anchor member is considerably greater than the distance between the first and second side edges 107, 108 of the face member, but the distance between the first and second end portions 151, 152 of the support member is considerably less than the spacing between support members of two abutting side-by-side wall units. This can be visualized most clearly from FIG. 7.

Consequently, a convex wall can be created by sliding the tongues of the anchor members further into the slots of the support members, up to the limiting condition in which the support members abut the end portions of the open frame bodies of the anchor members. In this situation, each support member makes an acute angle with its respective face member, as shown in FIG. 20. To obtain this closer spacing at the rear of the units, compared with at the front, it will be necessary to remove the outer ends of the tongues, by an amount determined by the desired curvature of the wall. This removal can be facilitated by providing sets of spaced transverse grooves or score lines (not shown) on the faces of the tongues. The desired amount of tongue can then be broken off by striking the tongue with a hammer adjacent to the appropriate score line.

To produce a wall of concave curvature, the tongues of the anchor members are not inserted through the slots in the support members far enough for the ends of the tongues to contact the corresponding end portions of the adjacent anchor members. In this situation, each support member makes an obtuse angle with its respective face member, as shown in FIG. 21. The limiting curvature for a concave wall is determined by the unmodified length of the tongues, which must be inserted sufficiently into the slots of the support member, to interlock the units together.

As mentioned previously, the design of wall unit 201 does not provide the same degree of flexibility as wall unit 101. In order to obtain the same degree of curvature in a convex wall, it is necessary to provide special wall units 201 having anchor members 204 that are shorter than face members 202, as shown in FIG. 20. Conversely, the anchor members 204 must be longer than the face members 202 to obtain the same degree of curvature in a concave wall, as shown by FIG. 21.

The two embodiments of wall units 101 and 201 discussed previously are suitable for creating a retaining wall of any desired length, simply by setting the required number of units side-by-side. Additional elements are needed, however, to complete the ends of the wall or to make a corner at an intersection of two walls.

Figure 23:
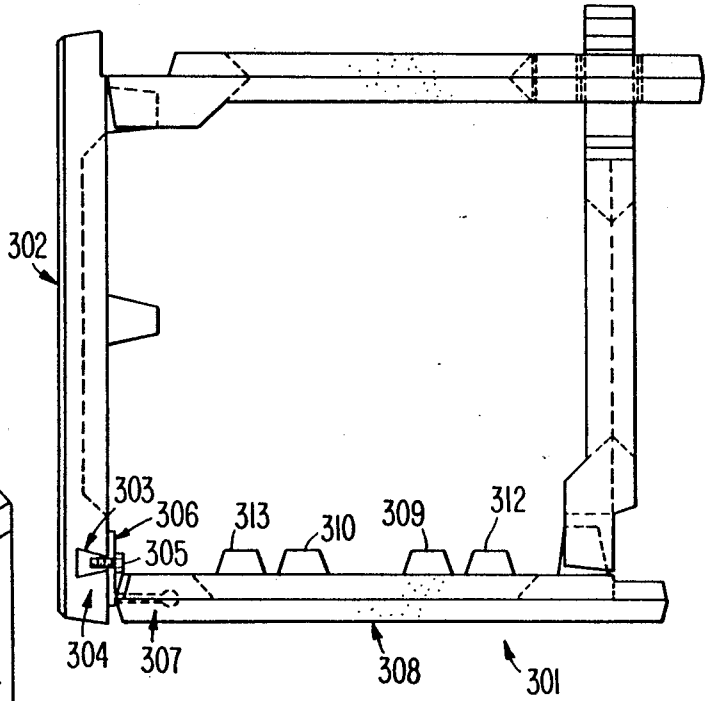
FIG. 23 is a top plan view of the right end unit of FIG. 22.
Figure 22:
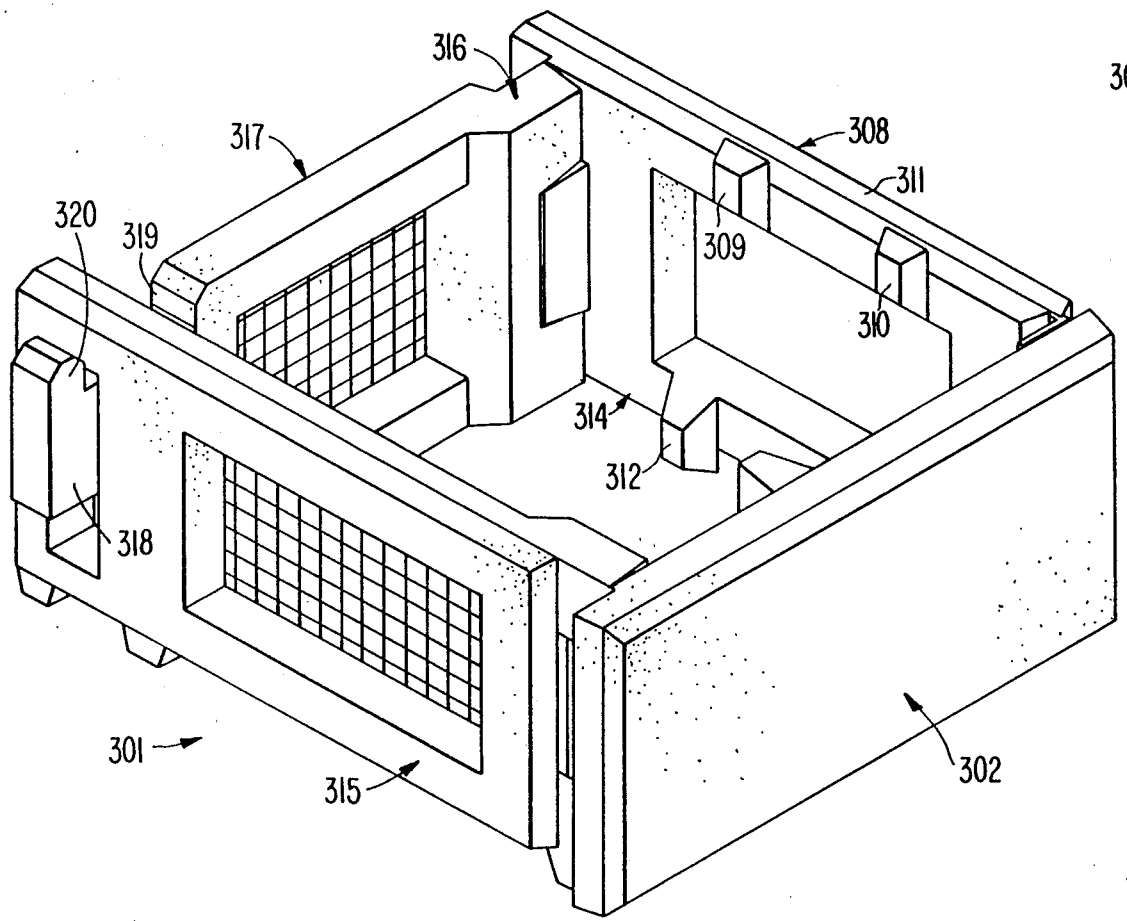
FIG. 22 is a perspective view of an embodiment of a four-member unit for terminating the right end of a retaining wall.

FIGS. 22 and 23 are perspective and top plan views, respectively, of a right end wall unit 301 having a full-width face member 302. This face member is modified from the face members 102 of the intermediate wall units of FIGS. 1–7 by elimination of the first, second, and third tabs 124, 125, 131, of the face member 102 and by inclusion of thermoplastic screw inserts 303 in a first end portion 304 of face member 302 (FIG. 23). These inserts receive bolts 305 for fastening one end of a plastic hinge 306, the other end of which is imbedded in a first side edge 307 of an end member 308. End member 308 is substantially a mirror image of face member 302, except for having a different arrangement of tabs for interlocking end members of successive courses of wall units.

End member 308 carries a pair of closely-spaced tabs 309 and 310 extending rearwardly adjacent to an upper edge 311 and another pair of more widely spaced tabs 312 and 313 extending rearwardly and downwardly adjacent to a lower edge 314. The spacing of the two pairs of tabs is such that the lower tabs of one end member will nest adjacent to the upper tabs of another end member of an end unit immediately below (see FIG. 23).

Face member 302 is hingedly attached to a support member 315 that is identical to the support members 103 of the intermediate wall units. End member 308 is hingedly attached to a second end 316 of an anchor member 317 having a tongue 318 extending from a first end 319. Tongue 318 is provided with a latching hook end 320 to lock the anchor member 317 to the support member 315.

Figure 25:
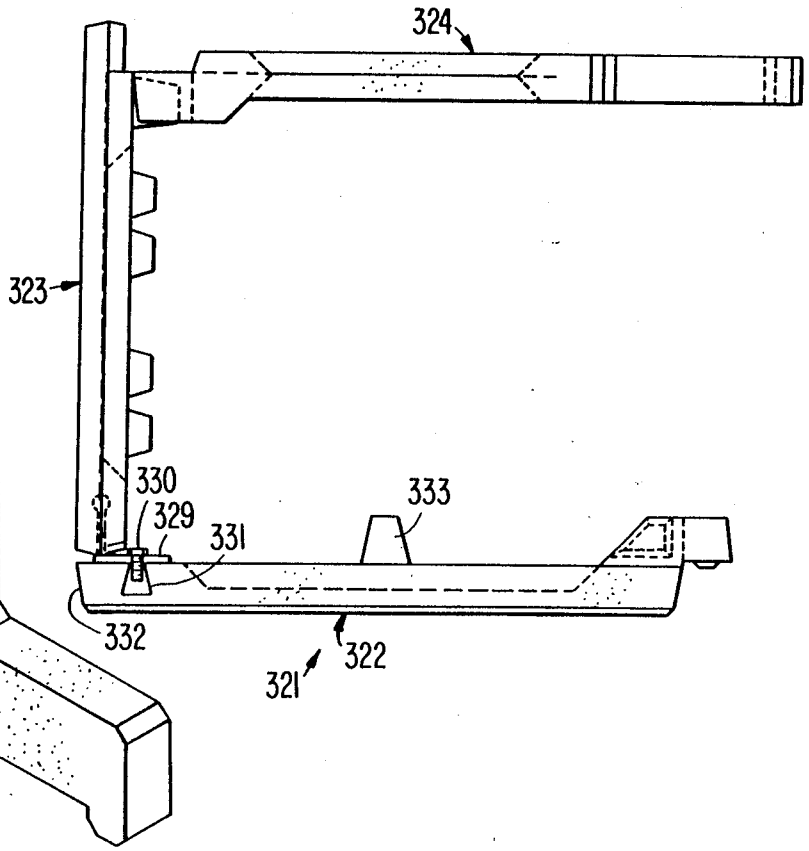
FIG. 25 is a top plan view of the left end unit of FIG. 24.
Figure 24:
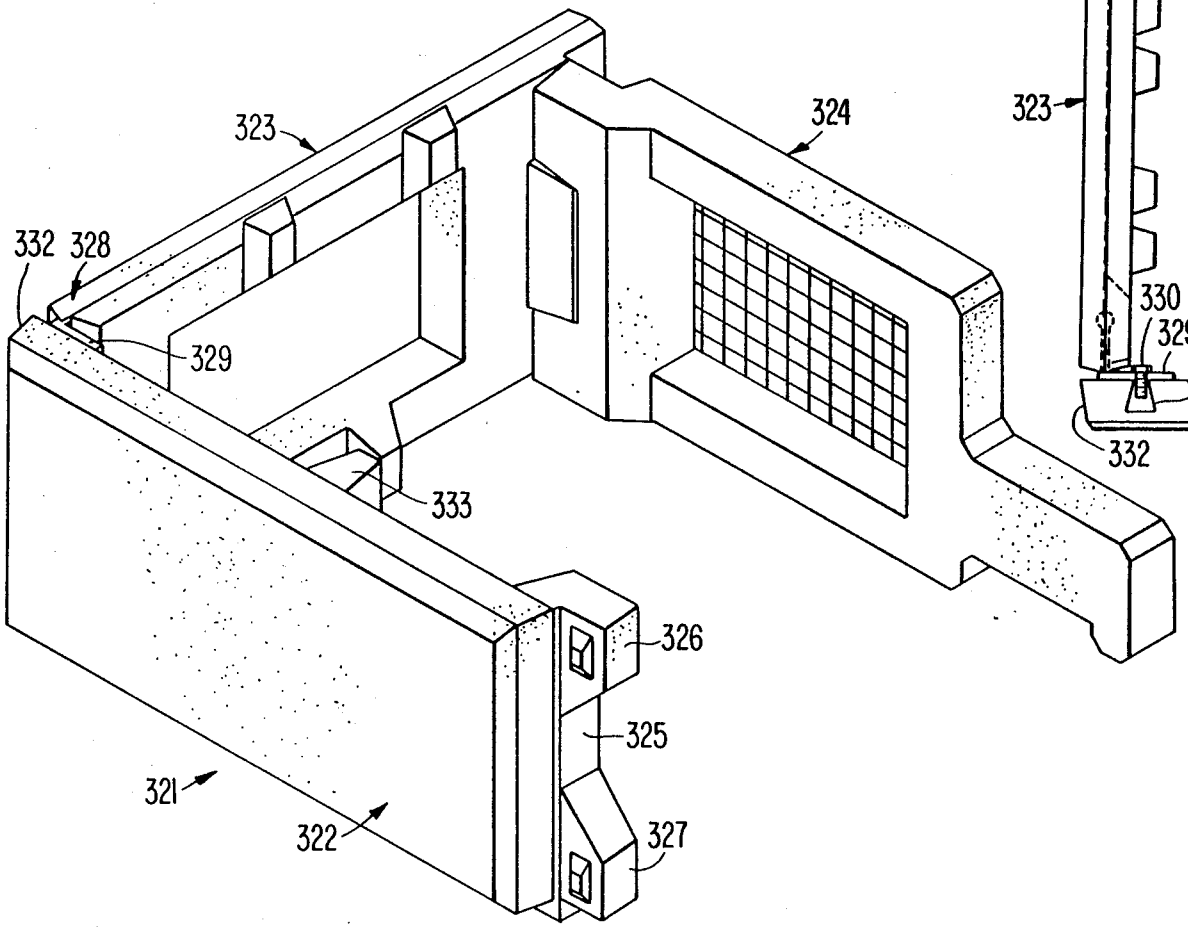
FIG. 24 is a perspective view of a first embodiment of a three-member unit for terminating the left end of a retaining wall.

With reference next to FIGS. 24 and 25, a full width left end unit 321 includes a face member 322, an end member 323, and an anchor member 324. The face member 322 has a first side edge 325 provided with first and second tabs 326 and 327, respectively, that are identical to the tabs 124, 125 on the face member 102 of the first embodiment (FIGS. 1–7). The opposite end of the face member is hingedly attached to a front end portion 328 of the support member by a plastic hinge 329 fastened by bolts 330 to plastic inserts 331 adjacent to a second side edge 332 of the first member. This type of hinge connection is identical to that used between the face member and the end member of the right hand end unit of FIGS. 22 and 23.

The face member of this left end unit is modified from the face member 102 of the basic unit 101 by eliminating a stop member corresponding to stop member 143. A tab 333 corresponding to fourth tab 132 is retained, however.

The left end member 323 and anchor member 324 are identical in all respects to the end member 308 and anchor member 317 of the right end wall unit, which reduces the required number of different molds to make a complete wall system.

Figure 27:
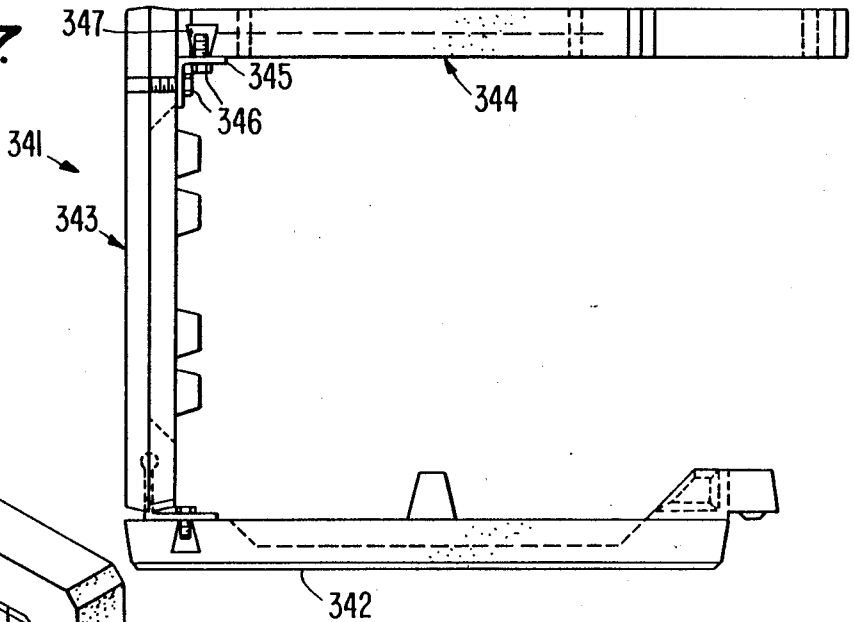
FIG. 27 is a top plan view of the left end unit of FIG. 26.
Figure 26:
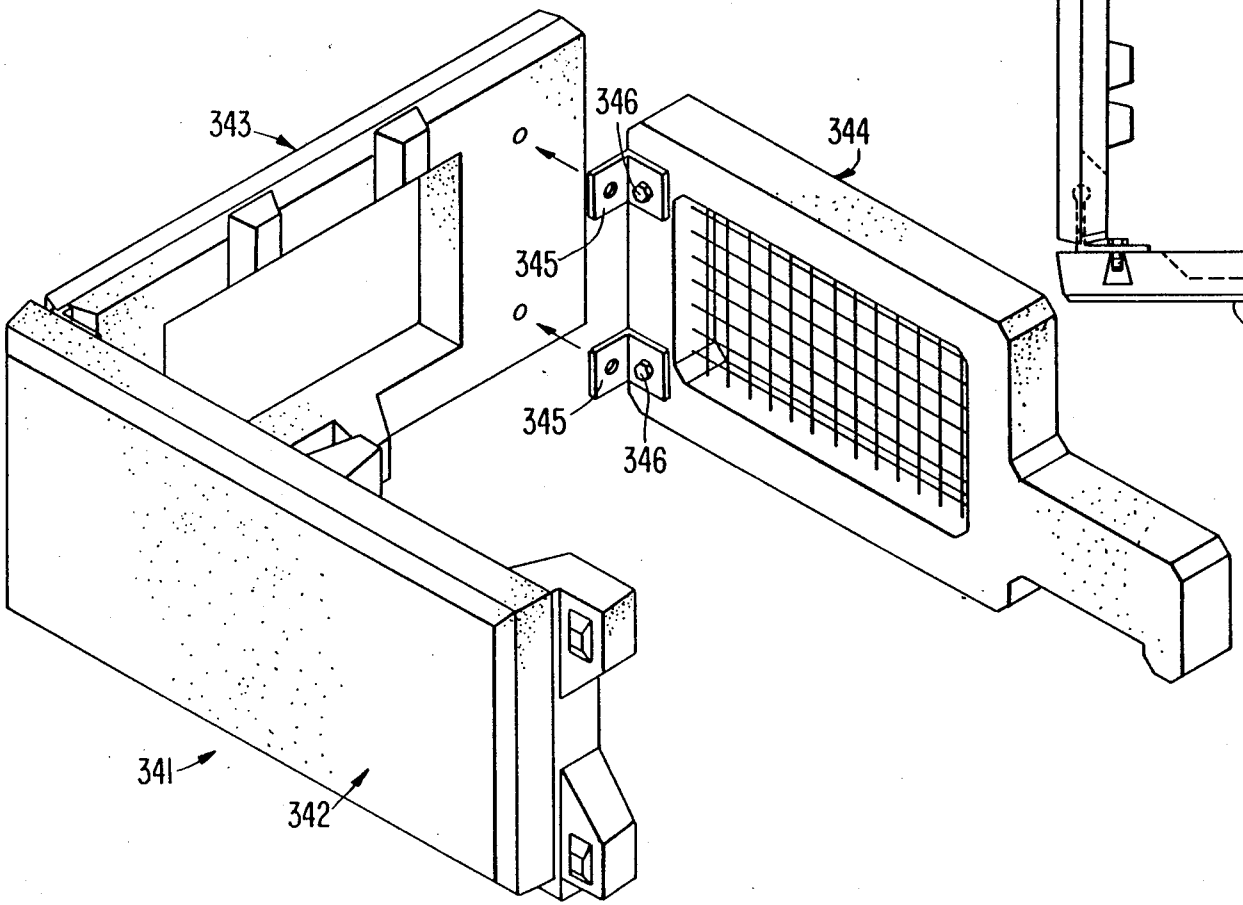
FIG. 26 is a perspective view of a second embodiment of a three-member unit for terminating the left end of a retaining wall.

FIGS. 26 and 27 illustrate an alternative embodiment 341 of a left end wall unit having an identical face member 342, but in which the junction between a left end member 343 and an anchor member 344 has been simplified and reduced in weight. The integral hinge with stop and mating recess of the embodiment of FIGS. 24 and 25 has been replaced by plain ends joined by two angle brackets 345 fastened by bolts 346 to respective plastic inserts 347. This alternative embodiment is equally usable in a right end wall unit.

Figure 29:
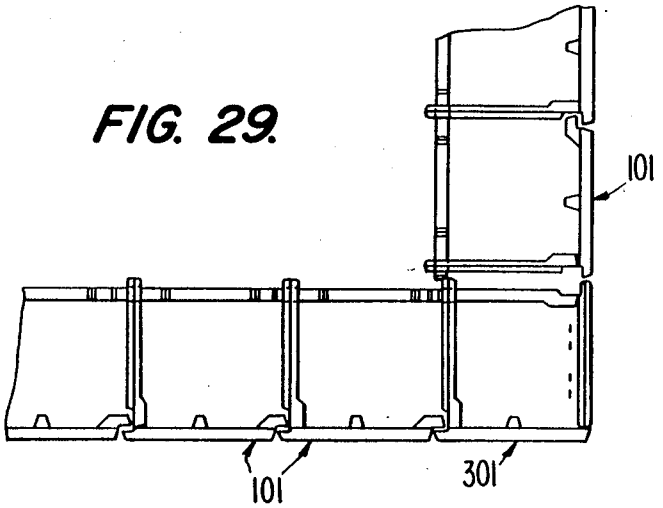
FIG. 29 is a top plan view showing a layout of wall units to form a right angle outside corner of a retaining wall.
Figure 30:
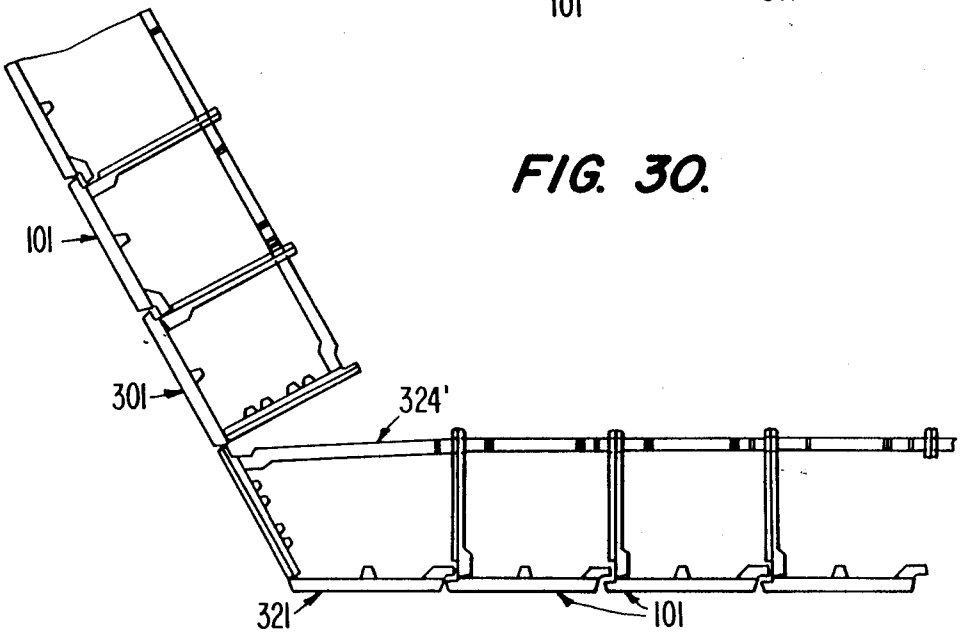
FIG. 30 is a top plan view showing a layout of wall units to form an obtuse angle outside corner of a retaining wall.
Figure 28:
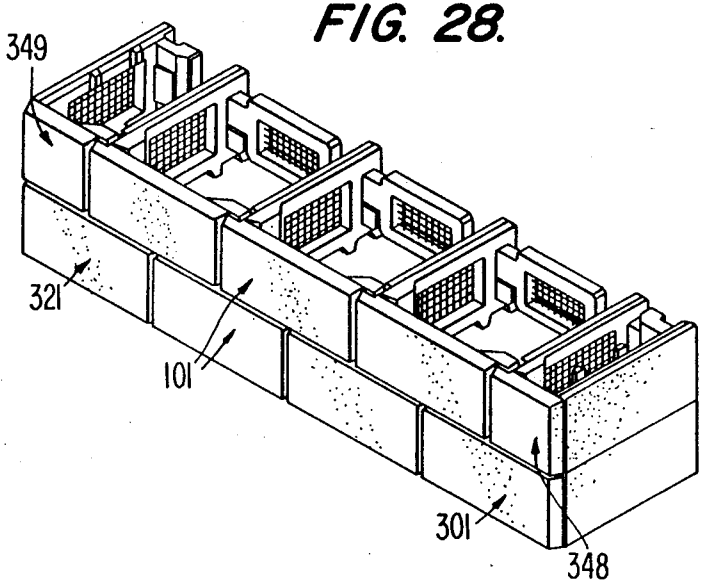
FIG. 28 is a perspective view of a two-course retaining wall with left end and right end units.

The various wall units described up to this point can be used for a full range of retaining wall requirements, as shown in FIGS. 28–30. FIG. 28 illustrates two courses of an assembled retaining wall structure incorporating basic wall units 101, a full-width right end wall unit 301, a full width left end wall unit 321, a half-width right end wall unit 348 and a half-width left end wall unit 349. The half-width end wall units are identical to the corresponding full-width units, except that the face member and anchor member in each case is only half as long.

As shown in the layouts of FIGS. 29 and 30, the wall units of the present invention can be used to construct angled retaining walls that meet at a right angle (FIG. 29) or at an obtuse angle (FIG. 30). In the latter case, the wall unit that forms the corner, in this case a left end wall unit 321, requires a specially cast elongated anchor member 324'. With a suitably shortened anchor member, the left end wall unit could be used in the case of walls meeting at an acute angle. In the same way, angle junctions can be incorporated in curved retaining wall systems like those in FIGS. 20 and 21, showing the great versatility possible with the hinged wall units of this invention.

In certain situations, particularly when the retaining wall may be subjected to substantial pressure on the rear of the face member, it is possible that the hinge joint between the face member and support member may creep or open up. This is particularly possible if the tensile reinforcing mesh that constitutes the hinge is made of plastic material without steel reinforcing.

Figure 31:
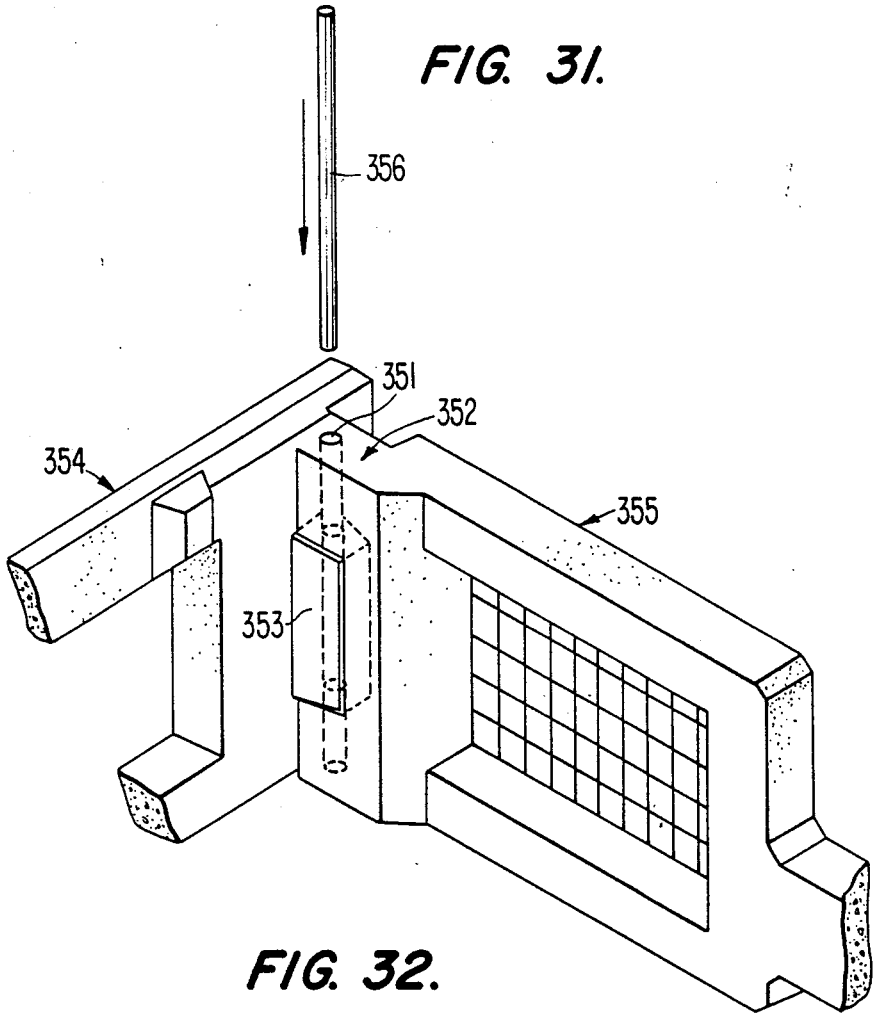
FIG. 31 is a perspective view of a modified hinged joint structure incorporating a drop-in locking pin.
Figure 32:
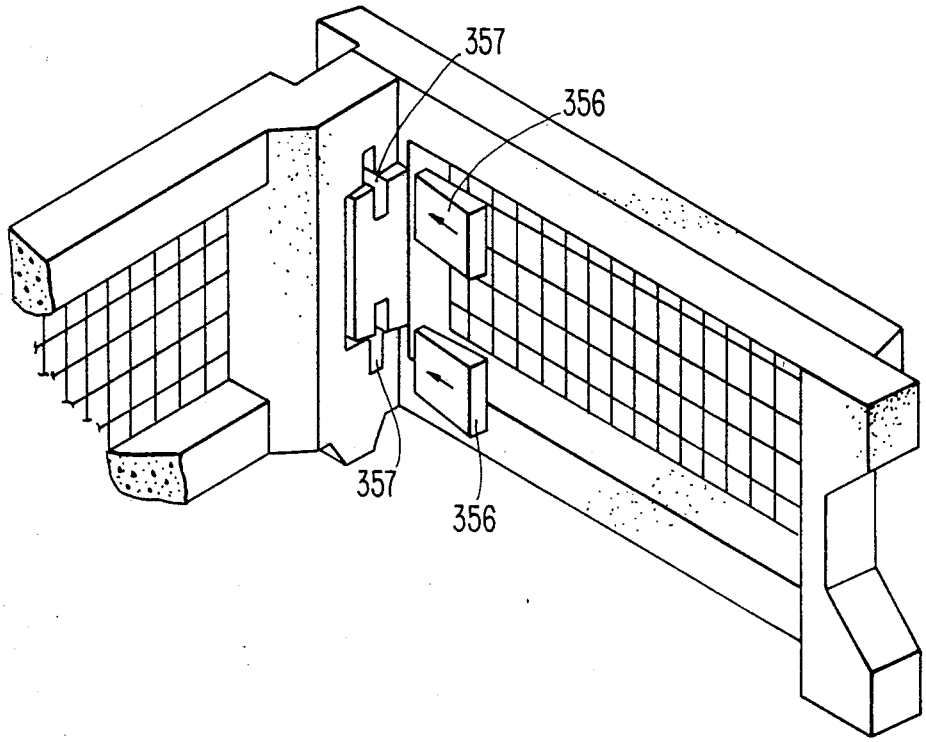
FIG. 32 is a perspective view of a modified hinged joint structure incorporating locking wedges.

FIGS. 31 and 32 illustrate alternative locking systems to prevent hinge creep in such a situation. FIG. 31 shows an arrangement in which a vertical hole 351 is drilled or formed through an end portion 352 and a stop 353 after two hinged members 354 and 355 have been folded to a desired angle. A pin 356 is then dropped into the hole to lock the two members 354 and 355. It should be noted that this drop-in pin acts as a lock to prevent relative pivoting movement between the two members; it does not act as a hinge pin.

An alternative arrangement shown in FIG. 32 uses wedges 356 inserted into vertical slots 357 for the same purpose.

In the discussion of retaining wall structures up to this point, all of the courses of the wall have been assembled from wall units of the same depth, that is, having support members of the same length. Walls built from such units have a maximum safe height, for the relative dimensions illustrated in the drawings, of about five to six courses. In the one foot by two foot face member size described earlier, this means a maximum wall height of five to six feet. These same units can be used, however, to construct a retaining wall 10 to 12 feet high by using wall units for the lower courses that have been modified by substituting extended-length support members.

Figure 33:
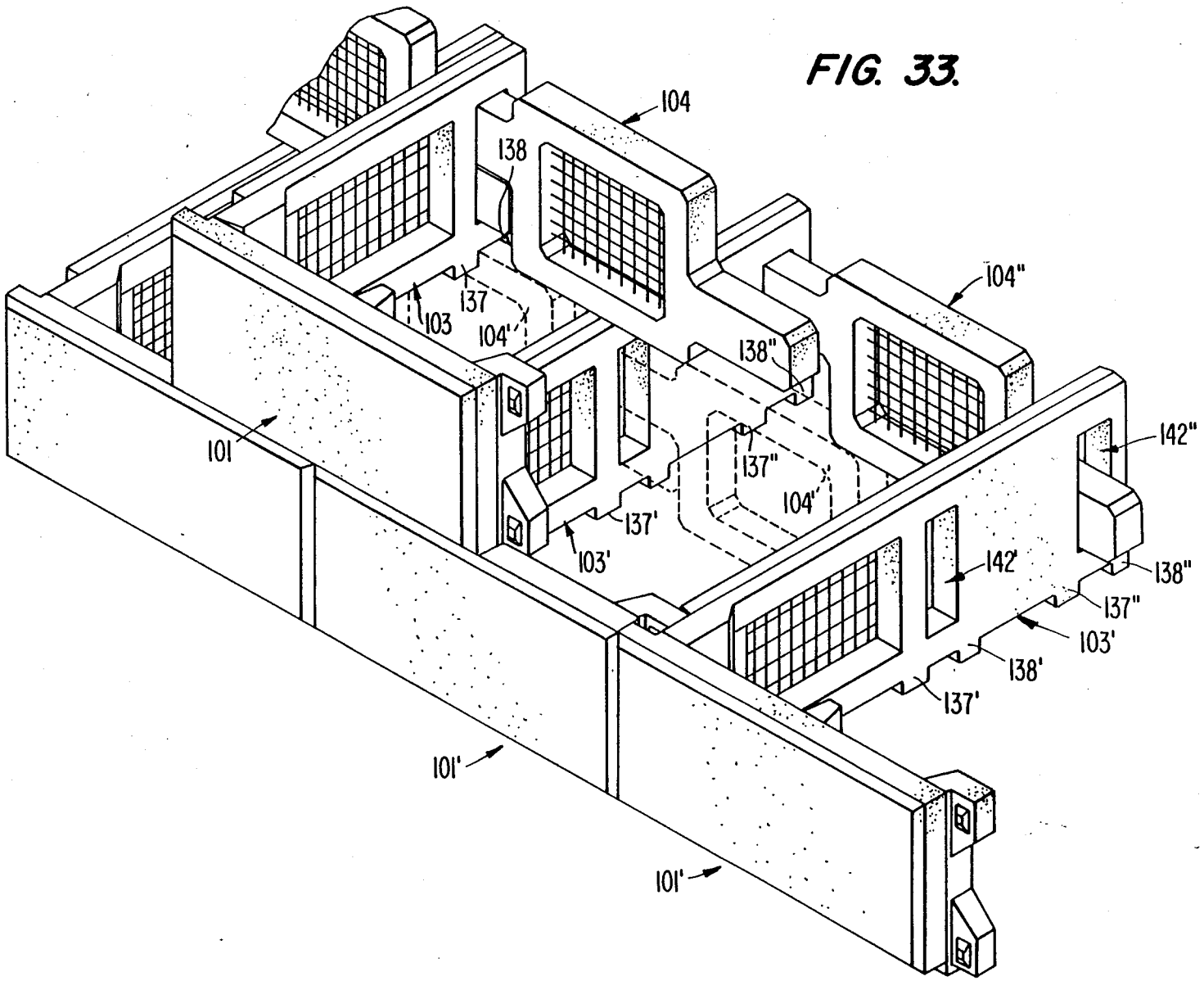
FIG. 33 is a perspective view of an arrangement using wall units having extended support members to provide stability for high retaining walls.

FIG. 33 shows in perspective view portions of a retaining wall assembly at a level of transition from modified wall units 101', having extended support members 103', to standard depth wall units 101 of the type and relative dimensions shown in FIGS. 1–7. The extended support members have spaced vertical slots 142' and 142'' for receiving the tongues of anchor members 104' and 104'', respectively. (The anchor members 104' are shown in dashed lines to avoid obscuring details of the other members).

The anchor members 104'' in the rear slots 142'' of the extended support members 103' provide additional resistance against overturning moments because of the greater lever arms of the elongated support members. The anchor members 104' in the front slots 142' also provide some overturning resistance, but their primary function is to provide an interlock with the first and second rear tabs 137, 138 of the support members 103 in the first course of standard size wall units 101. If additional courses of modified wall units 101' are needed below the transition course, only the rear slots 142'' need to be provided with anchor members; the front slots 142' of these lower courses can be left empty.

As an alternative to inserting anchor members into both the front and rear slots of the extended support members in the transition course, the next level or course of wall units can consist of modified instead of standard units, but with anchor members inserted only in the front slots. The extended support members, even without anchor members in the rear slots, provide greater stability than the standard depth wall units. This alternative arrangement is desirable, therefore, in situations where a normally permissible number of courses of standard units above the transition course may be marginal in terms of stability.

The foregoing description of various embodiments and arrangements of the wall units of the present invention illustrate their versatility and ease of manufacture, shipment, and installation. Other variations will be apparent to those of skill in the art, within the scope of the invention as comprehended in the following claims.

I claim:

1. A precast concrete retaining wall unit for use in constructing a bin-type retaining wall composed of superposed rows of such units, the unit comprising:

a face member having a front surface, a rear surface, an upper edge, a lower edge, and first and second side edges;

a support member having a front end portion adjacent to the second side edge of the face member, a rear end portion spaced from the front end portion, and an intermediate portion connecting the front and rear end portions;

means for hingedly connecting the front end portion of the support member to the rear surface of the face member adjacent to the second side edge of the face member to permit pivoting the support member with respect to the face member through at least 90 degrees between a position in which the support member is parallel to the face member to a position in which the support member extends transversely to the rear surface of the face member;

first and second interengaging means located in the vicinity of the respective first and second side edges of the face member, said first interengaging means of said unit being adapted to engage the second interengaging means of a like unit, when the second side edge of the face member of the like unit abuts the first side edge of the face member of said unit, to restrain the face member of said unit from forward movement with respect to the face member of the like unit; and third and fourth interengaging means located in the vicinity of the upper and lower edges of the face member, respectively, said third interengaging means of said unit being adapted to engage the fourth interengaging means of another like unit, when the lower edge of the face member of the other like unit abuts the upper edge of the face member of said unit with the other like unit being shifted laterally by a predetermined amount with respect to said unit, to restrain the face member of said other like unit from movement in at least one direction laterally and one direction transversely with respect to the face member of said unit.

2. A precast concrete retaining wall unit according to claim 1 wherein the means for hingedly connecting the front end portion of the support member to the face member comprises:

a flexible tensile reinforcing web disposed in a first intermediate plane of the face member and in a second intermediate plane of the support member, said web providing tensile reinforcement for the face member and the support member in addition to providing a hinge connection between the front end portion of the support member and the face member.

3. A precast concrete retaining wall unit according to claim 2 wherein the face member and the support member include interengaging stop means for limiting the pivoting angle of the support member with respect to the face member.

4. A precast concrete retaining wall unit according to claim 3 wherein the interengaging stop means comprises:

a protuberance extending from an inner face of one of the support member and the face member adjacent to the hinge connection, the protuberance contacting a surface on the other of the support member and the face member when the support member is pivoted to make a predetermined acute angle with the face member.

5. A precast concrete retaining wall unit according to claim 2 wherein the hinge means is an open-mesh metal web.

6. A precast concrete retaining wall unit according to claim 2 wherein the hinge means is a open-mesh web of high strength polymeric material.

7. A precast concrete retaining wall unit according to claim 1 wherein said first and second interengaging means comprise at least one tab having a front surface extending from the face member laterally beyond the first side edge and at least another tab having a rearward facing surface adjacent to the second side edge.

8. A precast concrete retaining wall unit for use in constructing a bin-type retaining wall composed of superposed rows of such units, the unit comprising:

a face member having a front surface, a rear surface, an upper edge, a lower edge, and first and second side edges;

a support member having a front end portion adjacent to the second side edge of the face member, a rear end portion spaced from the front end portion, and an intermediate portion connecting the front and rear end portions;

means for connecting the front end portion of the support member to the face member adjacent to the second side edge of the face member to permit the support member to extend transversely to the rear surface of the face member;

first and second interengaging means located in the vicinity of the respective first and second side edges of the face member, said first interengaging means of said unit being adapted to engage the second interengaging means of a like unit, when the second side edge of the face member of the like unit abuts the first side edge of the face member of said unit, to restrain the face member of said unit from forward movement with respect to the face member of the like unit; and third and fourth interengaging means located in the vicinity of the upper and lower edges of the face member, respectively, said third interengaging means of said unit being adapted to engage the fourth interengaging means of another like unit, when the lower edge of the face member of the other like unit abuts the upper edge of the face member of said unit with the other like unit being shifted laterally by a predetermined amount with respect to said unit, to restrain the face member of said other like unit from movement in at least one direction laterally and one direction transversely with respect to the face member of said unit, wherein said first and second interengaging means comprise at least one tab having a front surface extending from the face member laterally beyond the first side edge and at least another tab having a rearward facing surface adjacent to the second side edge, and wherein said third and fourth interengaging means comprise a pair of tabs respectively located adjacent each of the first and second side edges and one of the upper and lower edges of the face member and a third tab located adjacent to the other of the upper and lower edges intermediate the first and second side edges of the face member of each retaining wall unit, one of said pair of tabs of the one unit engaging the third tab of the other unit when the one unit is laterally offset with respect to the other unit by approximately half the distance between the first and second side edges of the face members.

9. A precast concrete retaining wall unit for use in constructing a bin-type retaining wall composed of superposed rows of such units, the unit comprising:

a face member having an upper edge, a lower edge, and first and second side edges;

a support member having a front end portion adjacent to the second side edge of the face member, a rear end portion spaced from the front end portion, and an intermediate portion connecting the front and rear end portions;

means for hingedly connecting the front end portion of the support member to the rear surface of the face member adjacent to the second side edge of the face member to permit pivoting the support member with respect to the face member through at least 90 degrees between a position in which the support member is parallel to the face member to a position in which the support member extends transversely to the rear surface of the face member;

an anchor member having a first end portion, a second end portion spaced from the first end portion, and an intermediate portion connecting the first and second end portions; and means for connecting the first end portion of the anchor member to the rear end portion of the support member;

first and second interengaging means located in the vicinity of the respective first and second side edges of the face member, said first interengaging means of said unit being adapted to engage the second interengaging means of a like unit, when the second side edge of the face member of the like unit abuts the first side edge of the face member of said unit, to restrain the face member of said unit from forward movement with respect to the face member of the like unit; and third and fourth interengaging means located in the vicinity of the upper and lower edges of the face member, respectively, said third interengaging means of said unit being adapted to engage the fourth interengaging means of another like unit, when the lower edge of the face member of the other like unit abuts the upper edge of the face member of said unit with the other like unit being shifted laterally by a predetermined amount with respect to said unit, to restrain the face member of said other like unit from movement in at least one direction laterally and one direction transversely with respect to the face member of said unit.

10. A precast concrete retaining wall unit according to claim 9, the unit further comprising means for locking the hinge joint between the face member and the support member when the support member is approximately perpendicular to the face member.

11. A precast concrete retaining wall unit according to claim 9 wherein the means for connecting the first end portion of the anchor member to the rear end portion of the support member comprises means for hingedly connecting the anchor member to the support member.

12. A precast concrete retaining wall unit according to claim 11 wherein the means for hingedly connecting the support member to the face member and the means for hingedly connecting the anchor member to the support member comprise:

a flexible tensile reinforcing web disposed in a first intermediate plane of the face member, in a second intermediate plane of the support member, and in a third intermediate plane of the anchor member, said web providing tensile reinforcement for the face member, the support member, and the anchor member, in addition to providing a hinge connection between the front end portion of the support member and the second side edge of the face member and between the rear end portion of the support member and the first end portion of the anchor member.

13. A precast concrete retaining wall unit according to claim 12 wherein the reinforcing web is an open-mesh metal web.

14. A precast concrete retaining wall unit according to claim 12 wherein the reinforcing web is an open-mesh web of high strength polymeric material.

15. A precast concrete retaining wall unit according to claim 9 wherein said first and second interengaging means comprise at least one tab having a front surface extending from the face member laterally beyond the first side edge and at least another tab having a rearward facing surface adjacent to the second side edge.

16. A precast concrete retaining wall unit according to claim 9, the unit further comprising:

an additional support member having a front end portion, a rear end portion spaced from the front end portion, and an intermediate portion connecting the front and rear end portions;

means for connecting the front end portion of the additional support member to the first side edge of the face member; and means for connecting the rear end portion of the additional support member to the second end portion of the anchor member, whereby said additional support member forms the fourth side of box-like unit.

17. A precast concrete retaining wall unit according to claim 16 wherein the connecting portions of the first named and the additional support members comprise spaced apart upper and lower portions that form, with the respective front and rear end portions of each support member, a rectangular open frame.

18. A precast concrete retaining wall unit for use in constructing a bin-type retaining wall composed of superposed rows of such units, the unit comprising:

a face member having a front surface, a rear surface, an upper edge, a lower edge, and first and second side edges;

a support member having a front end portion adjacent to the second side edge of the face member, a rear end portion spaced from the front end portion, and an intermediate portion connecting the front and rear end portions;

means for connecting the front end portion of the support member to the face member adjacent to the second side edge of the face member to permit the support member to extend transversely to the rear surface of the face member;

an anchor member having a first end portion, a second end portion spaced from the first end portion, and an intermediate portion connecting the first and second end portions; and means for connecting the first end portion of the anchor member to the rear end portion of the support member;

first and second interengaging means located in the vicinity of the respective first and second side edges of the face member, said first interengaging means of said unit being adapted to engage the second interengaging means of a like unit, when the second side edge of the face member of the like unit abuts the first side edge of the face member of said unit, to restrain the face member of said unit from forward movement with respect to the face member of the like unit; and third and fourth interengaging means located in the vicinity of the upper and lower edges of the face member, respectively, said third interengaging means of said unit being adapted to engage the fourth interengaging means of another like unit, when the lower edge of the face member of the other like unit abuts the upper edge of the face member of said unit with the other like unit being shifted laterally by a predetermined amount with respect to said unit, to restrain the face member of said other like unit from movement in at least one direction laterally and one direction transversely with respect to the face member of said unit, wherein the means for connecting the first end portion of the anchor member to the rear end portion of the support member comprises a tongue extending from the first end portion of the anchor member, the tongue extending into a slot formed in the rear end portion of the support member.

19. A precast concrete retaining wall unit according to claim 18, wherein the rear end portion of the support member includes two spaced apart slots, and the tongue of the anchor member is inserted into a rearmost one of said slots.

20. A precast concrete retaining wall unit according to claim 18 wherein the tongue is formed with a hooked outer end for latching the anchor member to the support member when the tongue is inserted through the slot.

* * * * *